US011248826B2

(12) United States Patent
Yamada et al.

(10) Patent No.: US 11,248,826 B2
(45) Date of Patent: Feb. 15, 2022

(54) REFRIGERANT-AMOUNT DETERMINING METHOD AND REFRIGERANT-AMOUNT DETERMINING DEVICE

(71) Applicant: DAIKIN INDUSTRIES, LTD., Osaka (JP)

(72) Inventors: Takuro Yamada, Osaka (JP); Yuusuke Nakagawa, Osaka (JP); Masahiro Honda, Osaka (JP); Yuusuke Oka, Osaka (JP); Hiroki Sasayama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 273 days.

(21) Appl. No.: 16/338,221

(22) PCT Filed: Sep. 29, 2017

(86) PCT No.: PCT/JP2017/035480
§ 371 (c)(1),
(2) Date: Mar. 29, 2019

(87) PCT Pub. No.: WO2018/062485
PCT Pub. Date: Apr. 5, 2018

(65) Prior Publication Data

US 2020/0033036 A1 Jan. 30, 2020

(30) Foreign Application Priority Data

Sep. 30, 2016 (JP) ..... JP2016-193142

(51) Int. Cl.
*F25B 45/00* (2006.01)
*F25B 1/00* (2006.01)
(Continued)

(52) U.S. Cl.
CPC ..... *F25B 45/00* (2013.01); *F25B 1/00* (2013.01); *F25B 5/02* (2013.01); *F25B 49/02* (2013.01);
(Continued)

(58) Field of Classification Search
CPC .... F25B 45/00; F25B 1/00; F25B 5/02; F25B 49/02; F25B 2345/001; F25B 2345/003
(Continued)

(56) References Cited

U.S. PATENT DOCUMENTS

2011/0224921 A1* 9/2011 Ko ..... F25B 45/00 702/55
2012/0318011 A1 12/2012 Ochiai et al.

FOREIGN PATENT DOCUMENTS

EP 1 876 403 A1 1/2008
EP 2 068 101 A1 6/2009
(Continued)

OTHER PUBLICATIONS

Extended European Search Report dated Sep. 19, 2019, for European Application No. 17856434.0.
(Continued)

*Primary Examiner* — Steve S Tanenbaum
(74) *Attorney, Agent, or Firm* — Birch, Stewart, Kolasch & Birch, LLP

(57) ABSTRACT

In a refrigeration apparatus including a refrigerant circuit in which a refrigerant in a gas-liquid two-phase state flows through a liquid-side connection pipe, a refrigerant-amount determining method and a refrigerant-amount determining device capable of grasping an appropriate refrigerant charging amount corresponding to the length of the connection pipe is provided. Provided is a refrigerant-amount determining method for a refrigerant to be charged to a refrigeration apparatus including a refrigerant circuit in which a com-
(Continued)

pressor, an outdoor heat exchanger that functions as a condenser, an outdoor expansion valve, indoor heat exchangers that function as evaporators, a liquid-side connection pipe that feeds the refrigerant, which has passed through the outdoor heat exchanger and then has been decompressed by the outdoor expansion valve, to each of the indoor heat exchangers, and a gas-side connection pipe that feeds the refrigerant, which has passed through each of the indoor heat exchangers, to a suction side of the compressor, are connected to one another. The method determines a refrigerant amount of the refrigerant to be charged to the refrigerant circuit such that a refrigerant amount per unit length of the liquid-side connection pipe increases as a length of the liquid-side connection pipe is larger.

13 Claims, 7 Drawing Sheets

(51) Int. Cl.
*F25B 5/02* (2006.01)
*F25B 49/02* (2006.01)

(52) U.S. Cl.
CPC ... *F25B 2345/001* (2013.01); *F25B 2345/003* (2013.01)

(58) Field of Classification Search
USPC ..... 62/77
See application file for complete search history.

(56) References Cited

FOREIGN PATENT DOCUMENTS

| | | | |
|---|---|---|---|
| EP | 2 264 386 | A1 | 12/2010 |
| EP | 2 369 270 | A1 | 9/2011 |
| GB | 2535051 | A | 8/2016 |
| JP | 8-200905 | A | 8/1996 |
| JP | 11-63745 | A | 3/1999 |
| JP | 2006-183953 | A | 7/2006 |
| WO | WO 2011/111114 | A1 | 9/2011 |
| WO | WO 2016/051606 | A1 | 4/2016 |

OTHER PUBLICATIONS

International Search Report issued in PCT/JP2017/035480 (PCT/ISA/210), dated Nov. 28, 2017.
International Preliminary Report on Patentability and English translation of the Written Opinion of the International Searching Authority for International Application No. PCT/JP2017/035480, dated Apr. 11, 2019.

* cited by examiner

| | | LENGTH OF LONGEST PORTION (m) | | | | | |
|---|---|---|---|---|---|---|---|
| | | ~30 | ~60 | ~90 | ~120 | ~150 | ~165 |
| CONNECTION CAPACITY (kW) | ~30 | 30% | 30% | 30% | 30% | 30% | 30% |
| | ~60 | 30% | 30% | 30% | 30% | 20% | 20% |
| | ~90 | 30% | 30% | 20% | 10% | 10% | 10% |
| | ~120 | 30% | 10% | 10% | 10% | 10% | 10% |
| | ~150 | 20% | 10% | 10% | 0% | 0% | 0% |

FIG. 7

REFRIGERANT-AMOUNT DETERMINING METHOD AND REFRIGERANT-AMOUNT DETERMINING DEVICE

TECHNICAL FIELD

The present invention relates to a refrigerant-amount determining method and a refrigerant-amount determining device.

BACKGROUND ART

Hitherto, on a site where an outdoor unit including a compressor and an outdoor heat exchanger, and an indoor unit including an indoor heat exchanger are installed, a refrigerant circuit is formed by connecting the outdoor unit and the indoor unit to each other using a connection pipe, and a refrigerant is additionally appropriately charged to the refrigerant circuit such that the refrigerant is sealed in the refrigerant circuit by an appropriate refrigerant amount.

For example, in an air conditioner described in PTL 1 (Japanese Unexamined Patent Application Publication No. 8-200905), it is suggested that a refrigerant is additionally charged by a specific refrigerant amount per unit length of a connection pipe, the specific refrigerant amount which is previously determined in accordance with the pipe diameter of the connection pipe, by taking into account that the length, the pipe diameter, and so forth, of the connection pipe that connects an outdoor unit and an indoor unit to each other change depending on the conditions of the installation site.

SUMMARY OF THE INVENTION

Technical Problem

In air conditioners of related art including the air conditioner in PTL 1, a refrigerant condensed by a heat exchanger that functions as a condenser of the refrigerant is fed to a liquid-side connection pipe, and hence a liquid refrigerant is transported through the liquid-side connection pipe. With such an air conditioner of related art, since it is presupposed that the liquid-side connection pipe is filled with the liquid refrigerant, the refrigerant amount of the refrigerant to be additionally charged can be grasped by simply multiplying the length of the liquid-side connection pipe by the specific refrigerant amount per unit length.

In another situation, the refrigerant amount of the refrigerant to be sealed in the refrigerant circuit is occasionally desired to be reduced by decompressing the refrigerant, which has been condensed by the heat exchanger that functions as the condenser, before the refrigerant is fed to the liquid-side connection pipe and generating a portion of the liquid-side connection pipe where a refrigerant in a gas-liquid two-phase state flows.

In the refrigerant circuit in which the refrigerant in the gas-liquid two-phase state flows through the liquid-side connection pipe, the liquid-side connection pipe is not filled with the liquid refrigerant but the refrigerant in the gas-liquid two-phase state also exists therein. Thus, it is not possible to calculate the refrigerant amount of the refrigerant to be additionally charged on the basis of the idea that the refrigerant amount per unit length is constant even if the length of the connection pipe is changed as described in PTL 1.

As the liquid-side connection pipe to be constructed on the site becomes longer, the pressure loss occurring in the refrigerant during transportation increases, and a portion where the refrigerant in the liquid state, not the refrigerant in the gas-liquid two-phase state, flows increases, resulting in that a region where the refrigerant in the gas-liquid two-phase state can be fed is limited. Thus, making the refrigerant amount per unit length constant regardless of the length of the liquid-side connection pipe does not work.

The present invention is made from the above-described viewpoint, and an object of the present invention is, in a refrigeration apparatus including a refrigerant circuit in which a refrigerant in a gas-liquid two-phase state flows through a liquid-side connection pipe, to provide a refrigerant-amount determining method and a refrigerant-amount determining device capable of grasping an appropriate refrigerant charging amount corresponding to the length of the connection pipe.

Solution to Problem

A refrigerant-amount determining method according to a first aspect of the present invention is a refrigerant-amount determining method for a refrigerant to be charged to a refrigeration apparatus including a refrigerant circuit. The refrigerant circuit is configured such that a compressor, a condenser, a first expansion valve, an evaporator, a liquid-side connection pipe that feeds the refrigerant, which has passed through the condenser and then has been decompressed by the first expansion valve, to the evaporator, and a gas-side connection pipe that feeds the refrigerant, which has passed through the evaporator, to a suction side of the compressor are connected to one another. The refrigerant-amount determining method determines a refrigerant amount of the refrigerant to be charged to the refrigerant circuit such that a refrigerant amount per unit length of the liquid-side connection pipe increases as a length of the liquid-side connection pipe is larger.

The length of the liquid-side connection pipe is not limited; however, for example, in a case where the refrigeration apparatus including the refrigerant circuit includes an outdoor unit having the compressor, the condenser, and the first expansion valve, and an indoor unit having the evaporator, the length may be a length from the first expansion valve or a liquid-side shutoff valve to the indoor unit via the liquid-side connection pipe; or in a case where an indoor expansion valve is provided as a second expansion valve on the liquid-side connection pipe side of the evaporator in the indoor unit, the length may be a length to the indoor expansion valve. Alternatively, in a case where the refrigeration apparatus including the refrigerant circuit includes an outdoor unit having the compressor, the condenser, and the first expansion valve, and a plurality of indoor units each having the evaporator, the length may be a length from the first expansion valve or a liquid-side shutoff valve to a branch point of the liquid-side connection pipe branching toward the respective indoor units; or the length may be a length from the first expansion valve or the liquid-side shutoff valve to an indoor unit located at a farthest position in a refrigerant path; and in a case where an indoor expansion valve is further provided as a second expansion valve on the liquid-side connection pipe side of the evaporator in each indoor unit, the length may be a length from the first expansion valve or the liquid-side shutoff valve to the indoor expansion valve located at the farthest position in the refrigerant path.

With the refrigerant-amount determining method, determining the refrigerant amount of the refrigerant to be charged to the refrigerant circuit such that the refrigerant amount per unit length of the liquid-side connection pipe increases as the length of the liquid-side connection pipe is larger includes determining the refrigerant amount of the refrigerant to be charged to the refrigerant circuit such that the refrigerant amount per unit length of the liquid-side connection pipe increases stepwise as the length of the liquid-side connection pipe is larger.

In the refrigerant circuit using the refrigerant-amount determining method, the refrigerant, which has been passed through the condenser and then has been decompressed by the first expansion valve, is fed to the evaporator. Thus, the density of the refrigerant flowing through the liquid-side connection pipe can be decreased. As compared with a case where the refrigerant is not decompressed by the first expansion valve after the refrigerant has passed through the condenser, the refrigerant amount of the refrigerant to be charged to the refrigerant circuit can be decreased. Especially when the refrigerant flowing through at least a portion on the downstream side of the liquid-side connection pipe can be in a gas-liquid two-phase state, the refrigerant amount of the refrigerant to be charged to the refrigerant circuit can be sufficiently decreased.

While the refrigerant amount of the refrigerant to be charged to the refrigerant circuit varies depending on the length of the liquid-side connection pipe to be constructed on the site, the pressure loss occurring in the refrigerant during transportation increases as the length of the liquid-side connection pipe is larger, and a portion where the refrigerant in the liquid state, not the refrigerant in the gas-liquid two-phase state, flows increases, resulting in that a region where the refrigerant in the gas-liquid two-phase state can be fed is limited. Thus, it is not possible to simply calculate the refrigerant amount such that the refrigerant amount per unit length of the liquid-side connection pipe is constant like related art.

In contrast, with the refrigerant-amount determining method according to this aspect, regarding the refrigerant amount of the refrigerant circuit in which operation is performed to decompress the refrigerant at the first expansion valve after the refrigerant has passed through the condenser and to send the refrigerant to the liquid-side connection pipe, the refrigerant amount of the refrigerant to be charged to the refrigerant circuit is determined such that the refrigerant amount per unit length of the liquid-side connection pipe increases as the length of the liquid-side connection pipe is larger. Thus, even when the length of the liquid-side connection pipe is large and the pressure loss occurring in the refrigerant during transportation increases, an appropriate refrigeration cycle can be performed in the refrigerant circuit.

As described above, even when operation of decreasing the refrigerant amount of the refrigerant charged to the refrigerant circuit is performed, the refrigerant charging amount that allows the appropriate refrigeration cycle corresponding to the length of the refrigerant connection pipe to be executed can be grasped.

A refrigerant-amount determining method according to a second aspect of the present invention is the refrigerant-amount determining method according to the first aspect of the present invention, in which the refrigeration apparatus includes a liquid-side shutoff valve and a plurality of the evaporators that are connected in parallel with each other. The liquid-side connection pipe includes a liquid-side main pipe that extends from the liquid-side shutoff valve to a branch point located at an intermediate position of the liquid-side connection pipe, and branch pipes that are branched at the branch point and respectively extend to the plurality of evaporators. The refrigerant-amount determining method determines the refrigerant amount using a length from the first expansion valve or the liquid-side shutoff valve to the branch point via the liquid-side main pipe, the number of the branch pipes, and lengths of a plurality of the branch pipes.

With the refrigerant-amount determining method, the refrigerant amount is determined using the length from the first expansion valve or the liquid-side shutoff valve to the branch point via the liquid-side main pipe, the number of the branch pipes, and the lengths of the plurality of branch pipes. Thus, the appropriate refrigerant amount corresponding to the circuit configuration of the refrigerant circuit can be grasped.

A refrigerant-amount determining method according to a third aspect of the present invention is the refrigerant-amount determining method according to the first or second aspect of the present invention, in which the refrigerant amount is determined using a pipe diameter of the liquid-side connection pipe, the pipe diameter being determined in accordance with a horsepower of the refrigeration apparatus.

It is to be noted that "a pipe diameter of the liquid-side connection pipe, the pipe diameter being determined in accordance with a horsepower of the refrigeration apparatus" in this case includes a "pipe diameter of the liquid-side connection pipe, the pipe diameter being determined in accordance with a refrigerating capacity of the refrigeration apparatus". The refrigerating capacity includes various types of physical amounts indicative of, for example, the amount of heat that is taken from an object per unit time. Such a physical amount may be Japanese refrigeration ton, United States refrigeration ton, or the like.

In this case, the pipe diameter may be either of the inside diameter or the outside diameter; however, the pipe diameter is preferably the inside diameter to correctly specify an appropriate refrigerant amount.

In the refrigerant-amount determining method, the refrigerant amount is determined using the pipe diameter of the liquid-side connection pipe, the pipe diameter being determined in accordance with the horsepower of the refrigeration apparatus. Thus, the refrigerant amount that allows the appropriate refrigeration cycle to be executed in accordance with the horsepower of the refrigeration apparatus can be grasped.

A refrigerant-amount determining method according to a fourth aspect of the present invention is the refrigerant-amount determining method according to any one of the first to third aspects of the present invention, in which a correspondence, in which a predetermined refrigerant reducing rate or a predetermined refrigerant charging rate corresponding to each predetermined length range or each predetermined length of any of the length of the liquid-side connection pipe and, in a case where a plurality of indoor units are provided, a length from an end portion of the liquid-side connection pipe on the outdoor unit side to an indoor unit located at a farthest position in a refrigerant path is indicated for each horsepower of the refrigeration apparatus, is previously determined, and the refrigerant amount of the refrigerant to be charged to the refrigerant circuit is determined on the basis of the correspondence. In this case, the predetermined refrigerant reducing rate is a refrigerant reducing rate with reference to a refrigerant amount of a refrigerant charged to the liquid-side connection pipe in a case where the liquid-side connection pipe is filled with a liquid refrigerant. The predetermined refrigerant charging rate is a refrigerant charging rate with reference to the refrigerant amount of the refrigerant charged to the liquid-side connection pipe in the case where the liquid-side connection pipe is filled with the liquid refrigerant; or, in the case where the plurality of indoor units are provided, the predetermined refrigerant charging rate is a refrigerant charging rate with reference to a refrigerant amount of the refrigerant charged to the liquid-side connection pipe and the branch pipes when the liquid-side connection pipe and the branch pipes extending from the liquid-side connection pipe toward the respective indoor units are filled with the liquid refrigerant. A refrigerant amount is obtained by calculating (the refrigerant amount in the case of the filling with the liquid refrigerant)×(1−the predetermined refrigerant reducing rate), or a refrigerant amount is obtained by calculating (the refrigerant amount in the case of the filling with the liquid refrigerant)×(the predetermined refrigerant charging rate), and a refrigerant amount per unit length of the obtained refrigerant amount is determined to increase as the length of the liquid-side connection pipe or the length from the end portion of the liquid-side connection pipe on the outdoor unit side to the indoor unit located at the farthest position in the refrigerant path is larger, and as the horsepower of the refrigeration apparatus is larger.

The length of the liquid-side connection pipe in the case where the plurality of indoor units are provided may be, for example, a length from the end portion of the liquid-side connection pipe on the outdoor unit side to a branch point located at an intermediate position of the liquid-side connection pipe, or may be a length from the end portion of the liquid-side connection pipe on the outdoor unit side to the indoor unit located at the farthest position in the refrigerant path.

The predetermined refrigerant reducing rate in the case where the plurality of indoor units are provided is a refrigerant reducing rate with reference to the refrigerant amount of the refrigerant charged to the liquid-side connection pipe in a case where the liquid-side connection pipe including the branch pipes extending to the indoor units is filled with the liquid refrigerant.

The predetermined refrigerant charging rate in the case where the plurality of indoor units are provided is a refrigerant charging rate with reference to the refrigerant amount of the refrigerant charged to the liquid-side connection pipe in the case where the liquid-side connection pipe including the branch pipes extending to the indoor units is filled with the liquid refrigerant.

In this case, "previously determining a correspondence indicated for each horsepower of the refrigeration apparatus" includes "previously determining a correspondence indicated for each refrigerating capacity of the refrigeration apparatus". The refrigerating capacity includes various types of physical amounts indicative of, for example, the amount of heat that is taken from an object per unit time. Such a physical amount may be Japanese refrigeration ton, United States refrigeration ton, or the like.

The form of the previously determined correspondence is not limited, and for example, the correspondence may be a correspondence table, the correspondence may be literal explanation, or the correspondence may be a mathematical expression.

In the refrigerant-amount determining method, after the horsepower of the refrigeration apparatus to be constructed has been determined and the length of the liquid-side connection pipe used for the refrigeration apparatus to be constructed has been determined, the predetermined refrigerant reducing rate or the predetermined refrigerant charging rate corresponding to the refrigeration apparatus to be constructed on the basis of the correspondence can be grasped. By calculating (the refrigerant amount in the case of the filling with the liquid refrigerant)×(1−the predetermined refrigerant reducing rate) or by calculating (the refrigerant amount in the case of the filling with the liquid refrigerant)×(the predetermined refrigerant charging rate) using the predetermined refrigerant reducing rate or the predetermined refrigerant charging rate grasped in this way, the appropriate refrigerant amount corresponding to the horsepower of the refrigeration apparatus and the length of the pipe can be easily grasped.

A refrigerant-amount determining device according to a fifth aspect of the present invention is a refrigerant-amount determining device for a refrigerant to be charged to a refrigeration apparatus including a refrigerant circuit, and includes an entry unit, a refrigerant-amount determining unit, and an output unit. The refrigerant circuit is configured such that a compressor, a condenser, a first expansion valve, an evaporator, a liquid-side connection pipe that feeds the refrigerant, which has passed through the condenser and then has been decompressed by the first expansion valve, to the evaporator, and a gas-side connection pipe that feeds the refrigerant, which has passed through the evaporator, to a suction side of the compressor are connected to one another. The entry unit receives information on at least a length of the liquid-side connection pipe. The refrigerant-amount determining unit determines a refrigerant amount of the refrigerant to be charged to the refrigerant circuit such that a refrigerant amount per unit length of the liquid-side connection pipe increases as the length of the liquid-side connection pipe is larger, on the basis of the information on the length of the liquid-side connection pipe received by the entry unit. The output unit outputs the refrigerant amount determined by the refrigerant-amount determining unit.

The length of the liquid-side connection pipe is not limited; however, for example, in a case where the refrigeration apparatus including the refrigerant circuit includes an outdoor unit having the compressor, the condenser, and the first expansion valve, and an indoor unit having the evaporator, the length may be a length from the first expansion valve or a liquid-side shutoff valve to the indoor unit via the liquid-side connection pipe; or in a case where an indoor expansion valve is further provided as a second expansion valve on the liquid-side connection pipe side of the evaporator in the indoor unit, the length may be a length to the indoor expansion valve. Alternatively, in a case where the refrigeration apparatus including the refrigerant circuit includes an outdoor unit having the compressor, the condenser, and the first expansion valve, and a plurality of indoor units each having the evaporator, the length may be a length from the first expansion valve or a liquid-side shutoff valve to a branch point of the liquid-side connection pipe branching toward the respective indoor units; the length may be a length from the first expansion valve or the liquid-side shutoff valve to an indoor unit located at a farthest position in a refrigerant path; or in a case where an indoor expansion valve is further provided as a second expansion valve on the liquid-side connection pipe side of the evaporator in each indoor unit, the length may be a length from the first expansion valve or the liquid-side shutoff valve to the indoor expansion valve located at the farthest position in the refrigerant path.

With the refrigerant-amount determining device, the configuration in which the refrigerant-amount determining unit determines the refrigerant amount of the refrigerant to be charged to the refrigerant circuit such that the refrigerant amount per unit length of the liquid-side connection pipe increases as the length of the liquid-side connection pipe is larger on the basis of the information on the length of the liquid-side connection pipe received by the entry unit includes a configuration in which the refrigerant-amount determining unit determines the refrigerant amount of the refrigerant to be charged to the refrigerant circuit such that the refrigerant amount per unit length of the liquid-side connection pipe increases stepwise as the length of the liquid-side connection pipe is larger.

In the refrigerant circuit using the refrigerant-amount determining device, the refrigerant, which has been passed through the condenser and then has been decompressed by the first expansion valve, is fed to the evaporator. Thus, the density of the refrigerant flowing through the liquid-side connection pipe can be decreased. As compared with a case where the refrigerant is not decompressed by the first expansion valve after the refrigerant has passed through the condenser, the refrigerant amount of the refrigerant to be charged to the refrigerant circuit can be decreased. Especially when the refrigerant flowing through at least a portion on the downstream side of the liquid-side connection pipe can be in a gas-liquid two-phase state, the refrigerant amount of the refrigerant to be charged to the refrigerant circuit can be sufficiently decreased.

While the refrigerant amount of the refrigerant to be charged to the refrigerant circuit varies depending on the length of the liquid-side connection pipe to be constructed on the site, the pressure loss occurring in the refrigerant during transportation increases as the length of the liquid-side connection pipe is larger, and a portion where the refrigerant in the liquid state, not the refrigerant in the gas-liquid two-phase state, flows increases, resulting in that a region where the refrigerant in the gas-liquid two-phase state can be fed is limited. Thus, it is not possible to simply calculate the refrigerant amount such that the refrigerant amount per unit length of the liquid-side connection pipe is constant like related art.

In contrast, with the refrigerant-amount determining device according to this aspect, regarding the refrigerant circuit in which operation is performed to decompress the refrigerant at the first expansion valve after the refrigerant has passed through the condenser and to send the refrigerant to the liquid-side connection pipe, the refrigerant-amount determining unit determines the refrigerant amount of the refrigerant to be charged to the refrigerant circuit such that the refrigerant amount per unit length of the liquid-side connection pipe increases as the length of the liquid-side connection pipe is larger on the basis of the information on the length of the liquid-side connection pipe received by the entry unit, and the output unit outputs the refrigerant amount. Thus, even when the length of the liquid-side connection pipe is large and the pressure loss occurring in the refrigerant during transportation increases, the refrigerant amount that allows the appropriate refrigeration cycle to be performed in the refrigerant circuit can be grasped by the output of the output unit.

As described above, even when operation of decreasing the refrigerant amount of the refrigerant charged to the refrigerant circuit is performed, the refrigerant charging amount that allows the appropriate refrigeration cycle corresponding to the length of the refrigerant connection pipe to be executed can be grasped.

A refrigerant-amount determining device according to a sixth aspect of the present invention is the refrigerant-amount determining device according to the fifth aspect of the present invention, in which the refrigeration apparatus includes a plurality of the evaporators that are connected in parallel with each other and a liquid-side shutoff valve that is provided between the plurality of evaporators and the first expansion valve. The liquid-side connection pipe includes a liquid-side main pipe that extends from the liquid-side shutoff valve to a branch point located at an intermediate position of the liquid-side connection pipe, and branch pipes that are branched at the branch point and respectively extend to the plurality of evaporators. The entry unit further receives information on a length from the first expansion valve or the liquid-side shutoff valve to the branch point via the liquid-side main pipe, the number of the branch pipes, and lengths of a plurality of the branch pipes. The refrigerant-amount determining unit determines the refrigerant amount using the information on the length from the first expansion valve or the liquid-side shutoff valve to the branch point via the liquid-side main pipe, the number of the branch pipes, and the lengths of the plurality of branch pipes received by the entry unit.

With the refrigerant-amount determining device, the refrigerant-amount determining unit determines the refrigerant amount using the length from the first expansion valve or the liquid-side shutoff valve to the branch point via the liquid-side main pipe, the number of the branch pipes, and the lengths of the plurality of branch pipes. Thus, the appropriate refrigerant amount corresponding to the circuit configuration of the refrigerant circuit can be grasped.

A refrigerant-amount determining device according to a seventh aspect of the present invention is the refrigerant-amount determining device according to the sixth aspect of the present invention, and the device further includes an image display unit. The image display unit displays the branch pipes and the evaporators by at least the number received by the entry unit, and the liquid-side main pipe using previously owned image data, and that displays input fields at positions corresponding to the plurality of branch pipes and the liquid-side main pipe, for receiving inputs of lengths of the plurality of branch pipes and the liquid-side main pipe. The entry unit receives values input in the input fields displayed on the image display unit.

With the refrigerant-amount determining device, the image display unit displays the branch pipes and the evaporators, and the liquid-side main pipe in the refrigerant circuit for which the refrigerant amount is to be determined using pipe configuration image data, and also displays the entry fields at the positions corresponding to the plurality of branch pipes and the liquid-side main pipe for receiving the inputs of the lengths of the plurality of branch pipes and the liquid-side main pipe. Thus, a user who determines the refrigerant amount by using the refrigerant-amount determining device can input the lengths of the individual branch pipes and the liquid-side main pipe while visually checking the circuit configuration of the refrigerant circuit for which the user determines the refrigerant amount. The user can easily check the correspondence between the pipes and the input length values for the pipes.

A refrigerant-amount determining device according to an eighth aspect of the present invention is the refrigerant-amount determining device according to any one of the fifth to seventh aspects of the present invention, in which the entry unit further receives information on a horsepower of the refrigeration apparatus. The refrigerant-amount determining unit obtains a pipe diameter of the liquid-side connection pipe, the pipe diameter being determined in accordance with the information on the horsepower received by the entry unit, on the basis of previously owned data, and determines the refrigerant amount using the pipe diameter of the liquid-side connection pipe.

In this case, the pipe diameter may be either of the inside diameter or the outside diameter; however, the pipe diameter is preferably the inside diameter to correctly specify the appropriate refrigerant amount.

It is to be noted that "information on a horsepower of the refrigeration apparatus" in this case includes "information on a refrigerating capacity of the refrigeration apparatus". The refrigerating capacity includes various types of physical amounts indicative of, for example, the amount of heat that is taken from an object per unit time. Such a physical amount may be Japanese refrigeration ton, United States refrigeration ton, or the like.

The refrigerant-amount determining device determines the refrigerant amount using the pipe diameter of the liquid-side connection pipe, the pipe diameter being determined in accordance with the horsepower of the refrigeration apparatus. Thus, the refrigerant amount that allows the appropriate refrigeration cycle to be executed in accordance with the horsepower of the refrigerant circuit can be grasped.

Advantageous Effects of Invention

With the refrigerant-amount determining method according to the first aspect, even when operation of decreasing the refrigerant amount of the refrigerant charged to the refrigerant circuit is performed, the refrigerant charging amount that allows the appropriate refrigeration cycle corresponding to the length of the refrigerant connection pipe to be executed can be grasped.

With the refrigerant-amount determining method according to the second aspect, the appropriate refrigerant amount corresponding to the circuit configuration of the refrigerant circuit can be grasped.

With the refrigerant-amount determining method according to the third aspect, the refrigerant amount that allows the appropriate refrigeration cycle to be executed in accordance with the horsepower of the refrigerant circuit can be grasped.

With the refrigerant-amount determining method according to the fourth aspect, the appropriate refrigerant amount corresponding to the horsepower of the refrigeration apparatus and the length of the pipe can be easily grasped.

With the refrigerant-amount determining device according to the fifth aspect, even when operation of decreasing the refrigerant amount of the refrigerant charged to the refrigerant circuit is performed, the refrigerant charging amount that allows the appropriate refrigeration cycle corresponding to the length of the refrigerant connection pipe to be executed can be grasped.

With the refrigerant-amount determining device according to the sixth aspect, the appropriate refrigerant amount corresponding to the circuit configuration of the refrigerant circuit can be grasped.

With the refrigerant-amount determining device according to the seventh aspect, the circuit configuration of the refrigerant circuit can be visually checked, and the correspondence between the pipes and the input length values of the pipes can be easily checked.

With the refrigerant-amount determining device according to the eighth aspect, the refrigerant amount that allows the appropriate refrigeration cycle to be executed in accordance with the horsepower of the refrigerant circuit can be grasped.

BRIEF DESCRIPTION OF THE DRAWINGS

FIG. 7 is a correspondence table of a predetermined refrigerant charging rate for each length of the longest portion and for each horsepower of the refrigeration apparatus according to Modification D.

DESCRIPTION OF EMBODIMENTS

A refrigerant-amount determining method according to an embodiment of the present invention and a refrigeration apparatus 1 to which the determining method is applied are described below with reference to the drawings. The following embodiment is a specific example of the present invention and does not limit the technical scope of the present invention. The embodiment can be appropriately changed within the scope of the invention.

(1) Configuration of Refrigeration Apparatus

Figure 1:
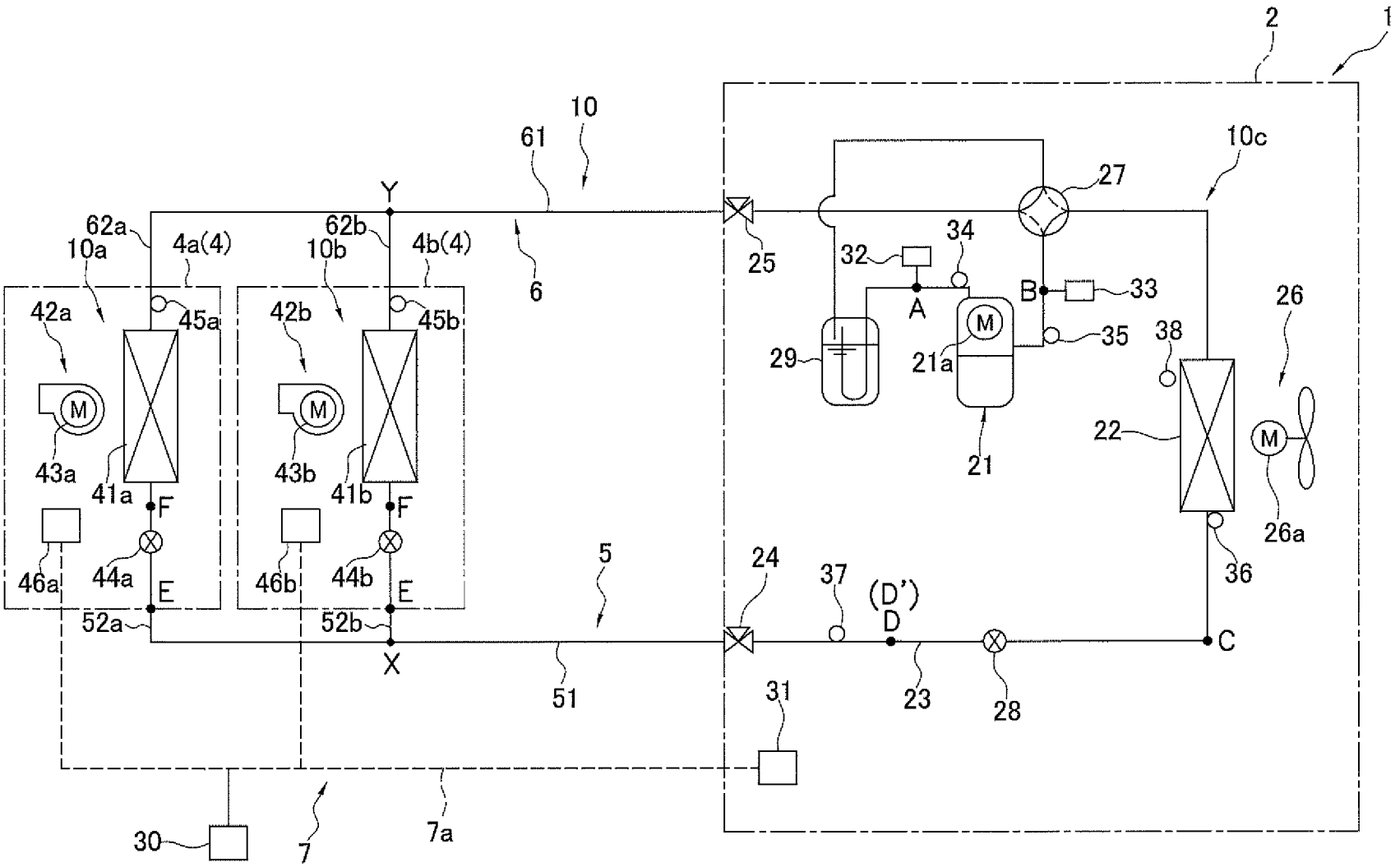
FIG. 1 is a general configuration diagram of a refrigeration apparatus that uses a refrigerant-amount determining method according to an embodiment of the present invention.

FIG. 1 is a schematic configuration diagram of the refrigeration apparatus 1.

The refrigeration apparatus 1 is an apparatus that is used for cooling and heating in a room of a building or the like through a vapor compression refrigeration cycle. The refrigeration apparatus 1 mainly includes an outdoor unit 2, an indoor unit 4 (a first indoor unit 4*a* and a second indoor unit 4*b*), and a liquid-side connection pipe 5 and a gas-side connection pipe 6 that connect the outdoor unit 2 and the indoor unit 4 to each other. That is, a vapor compression refrigerant circuit 10 of the refrigeration apparatus 1 is constituted by connecting the outdoor unit 2, the indoor unit 4, the liquid-side connection pipe 5, and the gas-side connection pipe 6 to one another.

The refrigerant circuit 10 of this embodiment is charged with R32 as a refrigerant.

(1-1) Indoor Unit

The indoor unit 4 is installed by being embedded in or hung from a ceiling in a room of a building or the like, or by being hooked to a wall surface in the room. The indoor unit 4 is connected to the outdoor unit 2 via the liquid-side connection pipe 5 and the gas-side connection pipe 6 and constitutes part of the refrigerant circuit 10 as a main circuit.

In this embodiment, a plurality of the indoor units 4 are connected to one another in parallel to one another in the refrigerant circuit 10. More specifically, the first indoor unit 4*a* and the second indoor unit 4*b* are connected in parallel with each other in the refrigerant circuit 10, and pipes branched from the liquid-side connection pipe 5 and the gas-side connection pipe 6 are connected to the first indoor unit 4*a* side and the second indoor unit 4*b* side.

A configuration of the first indoor unit 4*a* is described next.

The first indoor unit 4*a* mainly includes a first indoor-side refrigerant circuit 10*a* that constitutes part of the refrigerant circuit 10 serving as the main circuit. The first indoor-side refrigerant circuit 10*a* mainly includes a first indoor expansion valve 44*a* and a first indoor heat exchanger 41*a*.

The first indoor expansion valve 44*a* is an electronic expansion valve.

The first indoor heat exchanger 41*a* is a cross-fin type fin-and-tube heat exchanger constituted by a heat transfer tube and multiple fins. The first indoor heat exchanger 41*a* functions as an evaporator of a refrigerant to cool indoor air during cooling operation, and functions as a condenser of the refrigerant to heat the indoor air during heating operation.

The first indoor unit 4*a* includes a first indoor fan 42*a* that sucks the indoor air into the indoor unit 4*a*, that allows the first indoor heat exchanger 41*a* to exchange heat with the refrigerant, and then that supplies the indoor air as supply air into the room. The first indoor fan 42*a* is, for example, a centrifugal fan or a multi-blade fan, and has a first indoor fan motor 43*a* for driving.

The first indoor unit 4*a* is provided with a first indoor refrigerant temperature sensor 45*a* that detects a refrigerant temperature of the refrigerant flowing at the gas side of the first indoor heat exchanger 41*a*.

In addition, the first indoor unit 4*a* includes a first indoor control portion 46*a* that controls operation of respective components that constitute the first indoor unit 4*a*. The first indoor control portion 46*a* has, for example, a microcomputer and a memory provided for controlling the first indoor unit 4*a*, and hence can transmit and receive signals such as a control signal with respect to a remote controller (not illustrated) for individually operating the first indoor unit 4*a* and can transmit and receive signals such as a control signal with respect to the outdoor unit 2 via a transmission line 7*a*.

The second indoor unit 4*b* includes a second indoor-side refrigerant circuit 10*b* having a second indoor expansion valve 44*b* and a second indoor heat exchanger 41*b*; a second indoor fan 42*b* having a second indoor fan motor 43*b*; a second indoor refrigerant temperature sensor 45*b*; and a second indoor control portion 46*b*. The second indoor unit 4*b* has a configuration similar to that of the first indoor unit 4*a*, and hence the description is omitted here.

(1-2) Outdoor Unit

The outdoor unit 2 is installed outside a building or the like, is connected to the indoor unit 4 via the liquid-side connection pipe 5 and the gas-side connection pipe 6, and constitutes the refrigerant circuit 10 between the outdoor unit 2 and the indoor unit 4.

A configuration of the outdoor unit 2 is described next.

The outdoor unit 2 includes an outdoor-side refrigerant circuit 10*c* that constitutes part of the refrigerant circuit 10. The outdoor-side refrigerant circuit 10*c* mainly includes a compressor 21, an outdoor heat exchanger 22, an outdoor expansion valve 28, an accumulator 29, a four-way switching valve 27, a liquid-side shutoff valve 24, and a gas-side shutoff valve 25.

In this embodiment, the compressor 21 is a positive-displacement compressor that is driven by a compressor motor 21*a*. The compressor motor 21*a* is driven when receiving supply of electric power via an inverter device (not illustrated). The operating capacity can be made variable by making the frequency (that is, the number of rotations) variable.

The outdoor heat exchanger 22 is a cross-fin type fin-and-tube heat exchanger constituted by a heat transfer tube and multiple fins. The outdoor heat exchanger 22 functions as a radiator or a condenser of the refrigerant during cooling operation, and functions as an evaporator of the refrigerant during heating operation. The gas side of the outdoor heat exchanger 22 is connected to the compressor 21, and the liquid side thereof is connected to the outdoor expansion valve 28.

The outdoor unit 2 includes an outdoor fan 26 serving as a fan that sucks outdoor air into the outdoor unit 2, that allows the outdoor air to exchange heat with the refrigerant in the outdoor heat exchanger 22, and then that discharges the air to the outside. The outdoor fan 26 is a fan that allows the air volume of the outdoor air to be variable, as a heat source to be supplied to the outdoor heat exchanger 22. In this embodiment, the outdoor fan 26 is, for example, a propeller fan that is driven by an outdoor fan motor 26*a* that is a DC fan motor. The outdoor fan motor 26*a* is driven when receiving supply of electric power via an inverter device (not illustrated).

The outdoor expansion valve 28 is connected to the liquid side of the outdoor heat exchanger 22, for example, for adjusting the flow rate of the refrigerant flowing in the outdoor-side refrigerant circuit 10*c*. More specifically, in this embodiment, the outdoor expansion valve 28 in the refrigerant circuit 10 is provided between the outdoor heat exchanger 22 and the liquid-side shutoff valve 24.

The accumulator 29 is provided between the four-way switching valve 27 and the compressor 21 at a position on the suction side of the compressor 21. The accumulator 29 can separate the refrigerant in a liquid state from the refrigerant in a gas state.

The four-way switching valve 27 switches the connection state between a cooling operation connection state in which the discharge side of the compressor 21 is connected to the outdoor heat exchanger 22 and the downstream side of the accumulator 29 is connected to the gas-side shutoff valve 25, and a heating operation connection state in which the discharge side of the compressor 21 is connected to the gas-side shutoff valve 25 and the downstream side of the accumulator 29 is connected to the outdoor heat exchanger 22.

The liquid-side shutoff valve 24 and the gas-side shutoff valve 25 are valves provided at connecting ports for external devices and pipes (more specifically, the liquid-side connection pipe 5 and the gas-side connection pipe 6). The liquid-side shutoff valve 24 is connected via a pipe on the side opposite to the outdoor heat exchanger 22 side of the outdoor expansion valve 28. The gas-side shutoff valve 25 is connected to one of connecting ports of the four-way switching valve 27 via a pipe.

In addition, the outdoor unit 2 is provided with various sensors. More specifically, the outdoor unit 2 is provided with a suction pressure sensor 32 that detects a suction pressure of the compressor 21, a discharge pressure sensor 33 that detects a discharge pressure of the compressor 21, a suction temperature sensor 34 that detects a suction temperature of the compressor 21, a discharge temperature sensor 35 that detects a discharge temperature of the compressor 21, an outdoor heat-exchange liquid-side temperature sensor 36 that detects a temperature of the refrigerant at the liquid-side end of the outdoor heat exchanger 22 (outdoor heat-exchange outlet temperature), a liquid-pipe temperature sensor 37 that detects a temperature of the refrigerant flowing through the outdoor liquid-refrigerant pipe 23 that connects the outdoor expansion valve 28 and the liquid-side shutoff valve 24 to each other, and an outside-air temperature sensor 38 that serves as a temperature detector that detects an outside air temperature.

In addition, the outdoor unit 2 includes an outdoor control portion 31 that controls operation of respective components that constitute the outdoor unit 2. The outdoor control portion 31 has, for example, a microcomputer and a memory provided for controlling the outdoor unit 2, and an inverter circuit for controlling the compressor motor 21*a*, the outdoor fan motor 26*a*, and the outdoor expansion valve 28. Hence, the outdoor control portion 31 can transmit and receive signals such as a control signal with respect to the first indoor control portion 46*a* of the first indoor unit 4*a*, and the second indoor control portion 46*b* of the second indoor unit 4*b* via the transmission line 7*a*. That is, the first indoor control portion 46*a*, the second indoor control portion 46*b*, the outdoor control portion 31, and the transmission line 7*a* that connects the control portions to one another constitute a control unit 7 that controls operation of the entire refrigeration apparatus 1.

Figure 2:
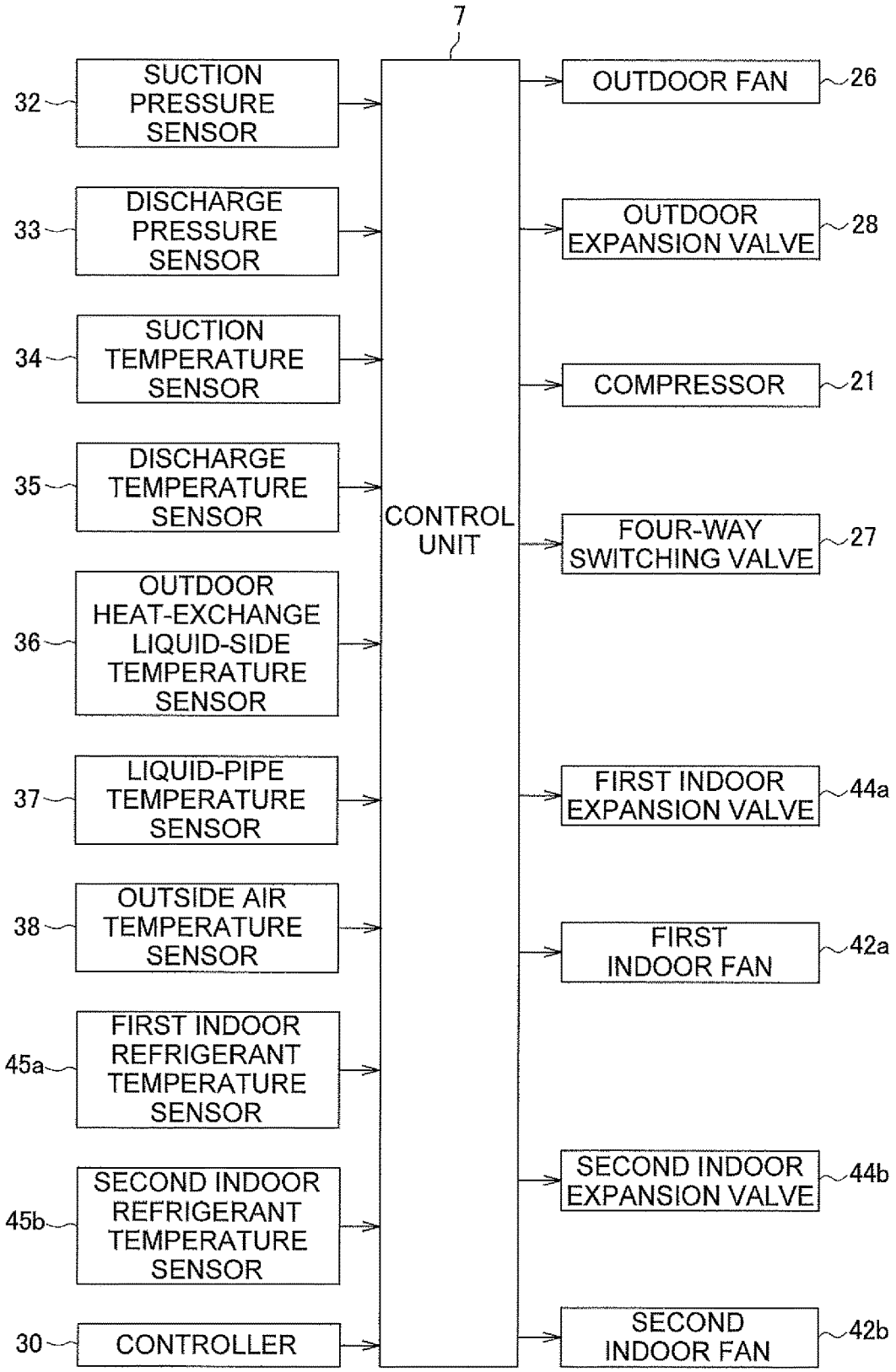
FIG. 2 is a block configuration diagram of a control system of the refrigeration apparatus.

As illustrated in FIG. 2, the control unit 7 is connected to be able to receive detection signals of the various sensors 32 to 38, 45*a*, and 45*b*, and is connected to be able to control various devices, the four-way switching valve 27, the compressor 21, the outdoor fan 26, the outdoor expansion valve 28, the first indoor expansion valve 44*a*, the first indoor fan 42*a*, the second indoor expansion valve 44*b*, and the second indoor fan 42*b* on the basis of the detection signals and so forth. FIG. 2 is a control block diagram of the refrigeration apparatus 1. The control unit 7 is connected to a controller 30 that receives various setting inputs from a user, and includes a memory (not illustrated).

(1-3) Connection Pipe

The connection pipes 5 and 6 are refrigerant pipes that are constructed on a site when the refrigeration apparatus 1 is installed at an installation location such as a building. The connection pipes 5 and 6 having various lengths and pipe diameters are used in accordance with installation conditions, such as an installation location, and a combination of an outdoor unit and an indoor unit.

By connecting the first indoor-side refrigerant circuit 10*a*, the second indoor-side refrigerant circuit 10*b*, the outdoor-side refrigerant circuit 10*c*, and the connection pipes 5 and 6 to one another, that is, by sequentially connecting the compressor 21, the outdoor heat exchanger 22, the outdoor expansion valve 28, the liquid-side connection pipe 5, the indoor expansion valve 44, the indoor heat exchanger 41, and the gas-side connection pipe 6, the refrigerant circuit 10 of the refrigeration apparatus 1 is constituted.

In this embodiment, the liquid-side connection pipe 5 includes a liquid-side main pipe 51 that extends from the liquid-side shutoff valve 24 to a branch point X at an intermediate position of the liquid-side connection pipe 5, a first indoor liquid-side branch pipe 52*a* that is branched at the branch point X and extends from the branch point X to the liquid side of the first indoor unit 4*a*, and a second indoor liquid-side branch pipe 52*b* that extends from the branch point X to the liquid side of the second indoor unit 4*b*. The gas-side connection pipe 6 includes a gas-side main pipe 61 that extends from the gas-side shutoff valve 25 to a branch point Y at an intermediate position of the gas-side connection pipe 6, a first indoor gas-side branch pipe 62*a* that is branched at the branch point Y and extends from the branch point Y to the gas side of the first indoor unit 4*a*, and a second indoor gas-side branch pipe 62*b* that extends from the branch point Y to the gas side of the second indoor unit 4*b*.

(2) Gas-Liquid Two-Phase Refrigerant Transport Control

The control unit 7 performs gas-liquid two-phase refrigerant transport control that causes a state in which the refrigerant in the gas-liquid two-phase state flows through the liquid-side connection pipe 5 during operation to actively occur in order to make the refrigerant amount of the refrigerant sealed in the refrigerant circuit 10 small.

An example in which the control unit 7 performs the gas-liquid two-phase refrigerant transport control when the refrigeration apparatus 1 performs cooling operation is described below.

Figure 3:
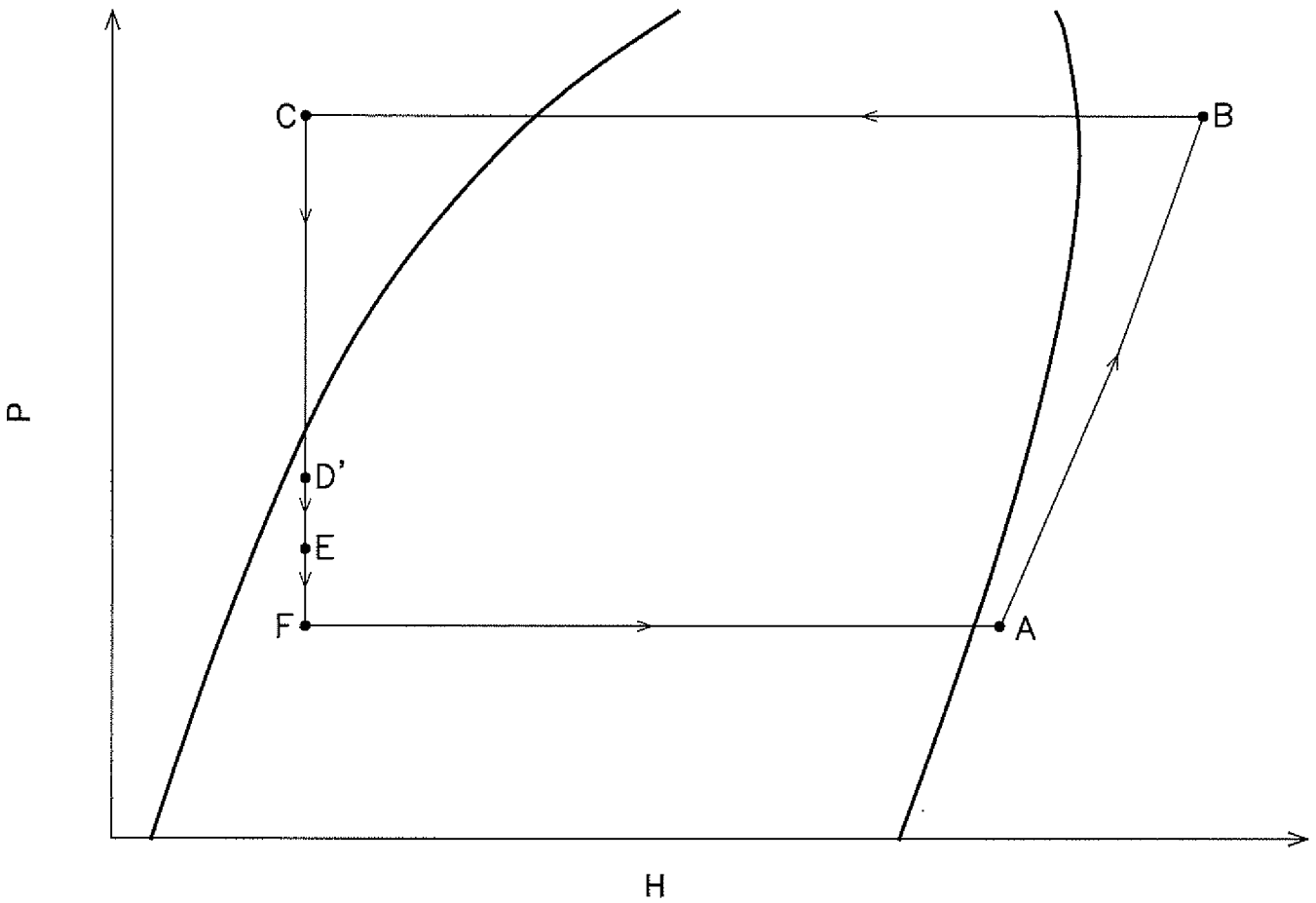
FIG. 3 is a Mollier diagram when a refrigerant after passing through an outdoor expansion valve is in a gas-liquid two-phase state in gas-liquid two-phase refrigerant transport control.
Figure 4:
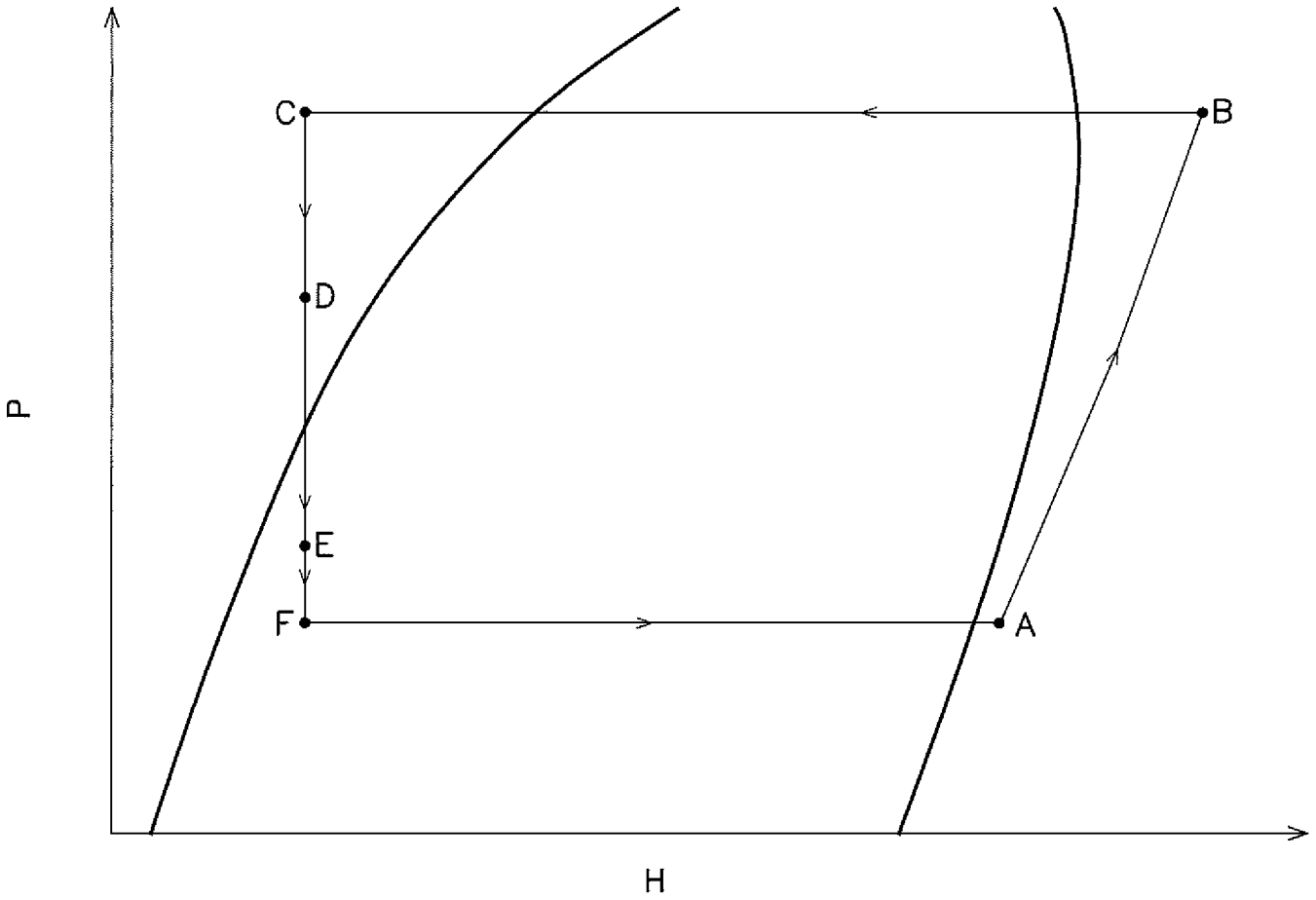
FIG. 4 is a Mollier diagram when the refrigerant after passing through the outdoor expansion valve is in a liquid state in the gas-liquid two-phase refrigerant transport control.

FIGS. 3 and 4 show examples of a refrigeration cycle when the gas-liquid two-phase refrigerant transport control is performed, with reference to signs A to F corresponding to signs A to F in the refrigerant circuit 10 in FIG. 1. A Mollier diagram in FIG. 3 shows an example in which the length of the liquid-side connection pipe 5 is relatively small and the refrigeration cycle can be appropriately performed even when the refrigerant which has passed through the outdoor expansion valve 28 is in the gas-liquid two-phase state. A Mollier diagram in FIG. 4 shows an example in which the length of the liquid-side connection pipe 5 is relatively large and the refrigeration cycle is performed while the refrigerant which has passed through the outdoor expansion valve 28 is the liquid refrigerant.

During cooling operation, the refrigeration cycle is performed in a state in which the connection state of the four-way switching valve 27 is switched such that the discharge side of the compressor 21 is on the side of the outdoor heat exchanger 22 and the suction side of the compressor 21 is on the side of each of the indoor heat exchangers 41*a* and 41*b*.

The frequency of the compressor 21 is controlled by the control unit 7 to have a target low pressure so that the compressor 21 can process a cooling load in each of certain indoor units. Thus, the refrigerant with a low pressure sucked by the compressor 21 (see point A in FIGS. 1, 3, and 4) is discharged from the compressor 21, becomes the refrigerant with a high pressure (see point B in FIGS. 1, 3, and 4), and flows into the outdoor heat exchanger 22 via the four-way switching valve 27.

The refrigerant flowing into the outdoor heat exchanger 22 radiates heat of the refrigerant and is condensed (see point C in FIGS. 1, 3, and 4).

The refrigerant flowing out from the outdoor heat exchanger 22 is decompressed by the outdoor expansion valve 28, and the pressure of the refrigerant decreases to an intermediate pressure between the high pressure and the low pressure of the refrigeration cycle (see point D' in FIGS. 1 and 3, or point D in FIGS. 1 and 4). Thus, the refrigerant after passing through the outdoor expansion valve 28 has a lower refrigerant density as compared with the refrigerant before passing through the outdoor expansion valve 28. In this case, the control unit 7 controls a valve opening degree of the outdoor expansion valve 28 such that the refrigerant flowing through at least a portion of the liquid-side connection pipe 5 located upstream of a downstream end portion is in the gas-liquid two-phase state. More specifically, the control unit 7 controls the valve opening degree of the outdoor expansion valve 28 such that a degree of subcooling of the refrigerant passing through the liquid-side end of the outdoor heat exchanger 22 is a predetermined target degree of subcooling. The control unit 7 obtains the degree of subcooling of the refrigerant at the liquid-side outlet of the outdoor heat exchanger 22 by subtracting a detected temperature of the outdoor heat-exchange liquid-side temperature sensor 36 from the temperature of the refrigerant obtained by converting a saturation temperature using a detected pressure of the discharge pressure sensor 33. The control unit 7 performs control to increase the valve opening degree of the outdoor expansion valve 28 if the degree of subcooling of the refrigerant passing through the liquid-side end of the outdoor heat exchanger 22 obtained as described above is larger than the target degree of subcooling, and performs control to decrease the valve opening degree of the outdoor expansion valve 28 if the degree of subcooling is smaller than the target degree of subcooling.

In this case, although not limited, the control unit 7 may cause a memory or the like to previously store, as a control target value, the target degree of subcooling, which is a control target value of the outdoor expansion valve 28. A specific value of the target degree of subcooling, which is the control target value of the outdoor expansion valve 28, is preferably previously determined as a value that enables the refrigerant flowing through at least the portion of the liquid-side connection pipe 5 located upstream of the downstream end portion to be in the gas-liquid two-phase state.

Whether the refrigerant after the refrigerant has been decompressed by the outdoor expansion valve 28 is the refrigerant in the liquid state or the gas-liquid two-phase state varies every constructed refrigeration apparatus in accordance with the length and so forth of the liquid-side connection pipe 5 to be constructed.

The refrigerant decompressed by the outdoor expansion valve 28 passes through the outdoor liquid-refrigerant pipe 23, the liquid-side shutoff valve 24, and the liquid-side connection pipe 5, and is fed to each of the indoor units 4*a* and 4*b*. In this case, a pressure loss occurs in the refrigerant passing through the outdoor liquid-refrigerant pipe 23 and the liquid-side connection pipe 5 during passage, and hence the pressure of the refrigerant decreases (see change from point D' to point E in FIGS. 1 and 3, or change from point D to point E in FIGS. 1 and 4). The pressure loss occurring in the refrigerant when the refrigerant passes through the liquid-side connection pipe 5 varies depending on the length, pipe diameter, and so forth, of the liquid-side connection pipe 5 to be constructed. As the length of the liquid-side connection pipe 5 is larger, or as the pipe diameter is smaller, a larger pressure loss occurs in the refrigerant.

The refrigerant, which has passed through the liquid-side main pipe 51 of the liquid-side connection pipe 5 and flowed to the branch point X, is branched, flows into the first indoor unit 4*a* via the first indoor liquid-side branch pipe 52*a*, and flows into the second indoor unit 4*b* via the second indoor liquid-side branch pipe 52*b*. The refrigerant flowing into the first indoor unit 4*a* is further decompressed to the low pressure of the refrigeration cycle by the first indoor expansion valve 44*a*, and the refrigerant flowing into the second indoor unit 4*b* is similarly further decompressed to the low pressure of the refrigeration cycle by the second indoor expansion valve 44*b* (see point F in FIGS. 1, 3, and 4). Although not limited, the control unit 7 may control the valve opening degree of the first indoor expansion valve 44*a* such that a degree of superheating of the refrigerant at the outlet side of the first indoor heat exchanger 41*a* is a predetermined target degree of superheating. In this case, the control unit 7 may obtain the degree of superheating of the refrigerant at the gas-side outlet of the first indoor heat exchanger 41*a* by subtracting the temperature of the refrigerant, which is obtained by converting a saturation temperature using a detected pressure of the suction pressure sensor 32, from a detected temperature of the first indoor refrigerant temperature sensor 45*a*. The valve opening degree of the second indoor expansion valve 44*b* is similarly controlled.

The refrigerant decompressed by the first indoor expansion valve 44*a* of the first indoor unit 4*a* is evaporated by the first indoor heat exchanger 41*a*, and flows toward the first indoor gas-side branch pipe 62*a*. Similarly, the refrigerant decompressed by the second indoor expansion valve 44*b* of the second indoor unit 4*b* is evaporated by the second indoor heat exchanger 41*b*, and flows toward the second indoor gas-side branch pipe 62*b*. The refrigerants evaporated by the first indoor heat exchanger 41*a* and the second indoor heat exchanger 41*b* are joined at a joint point Y at which the gas-side main pipe 61, the first indoor gas-side branch pipe 62*a*, and the second indoor gas-side branch pipe 62*b* of the gas-side connection pipe 6 are connected to one another, and the joined refrigerant is sucked again into the compressor 21 via the gas-side shutoff valve 25, the four-way switching valve 27, and the accumulator 29 of the outdoor unit 2 (see point F in FIGS. 1, 3, and 4).

(3) Determination of Refrigerant Amount

For the refrigerant circuit 10 of the refrigeration apparatus 1 that performs the gas-liquid two-phase refrigerant transport control during operation as described above, the refrigerant amount that allows the appropriate refrigeration cycle to be executed even when the gas-liquid two-phase refrigerant transport control is performed is determined in accordance with the lengths and so forth of the liquid-side connection pipe 5 and the gas-side connection pipe 6 of the refrigeration apparatus 1 to be constructed on the site, and the refrigerant is charged by the determined refrigerant amount.

In the outdoor unit 2, if a predetermined amount of the refrigerant has been previously charged in a state in which the liquid-side connection pipe 5 and the gas-side connection pipe 6 are not connected, the refrigerant amount of the refrigerant previously charged to the outdoor unit 2 may be subtracted from the determined refrigerant amount, and the refrigerant may be additionally charged to the refrigerant circuit 10 by the subtracted refrigerant amount.

In this case, when the refrigerant amount of the refrigerant to be charged to the refrigerant circuit 10 is determined, the refrigerant amount can be determined such that the refrigerant amount per unit length of the liquid-side connection pipe 5 increases as the length of the liquid-side connection pipe 5 to be constructed on the site is larger. Although not limited, for example, a correspondence of a refrigerant amount per unit length corresponding to a length of the liquid-side connection pipe 5 may be previously determined such that the refrigerant amount per unit length of the liquid-side connection pipe 5 increases as the length of the liquid-side connection pipe 5 is larger, the refrigerant amount per unit length corresponding to the length of the liquid-side connection pipe 5 of the refrigeration apparatus 1 to be constructed may be specified from the correspondence, and the refrigerant amount of the refrigerant to be sealed in the refrigerant circuit 10 to be constructed may be determined using the specified refrigerant amount per unit length. The correspondence of the refrigerant amount per unit length corresponding to the length of the liquid-side connection pipe 5 may be previously determined such that the refrigerant amount per unit length increases as the horsepower of the refrigeration apparatus 1 is larger. In this case, the horsepower of the refrigeration apparatus 1 is not limited. For example, the horsepower of the outdoor unit 2 included in the refrigeration apparatus 1 may be used; in a case where the refrigeration apparatus 1 includes one indoor unit 4, the horsepower of the indoor unit 4 may be used; or in a case where the refrigeration apparatus 1 includes a plurality of indoor units 4 (the first indoor unit 4*a* and the second indoor unit 4*b*), the sum total of the respective horsepowers of the indoor units 4 may be used.

More specifically, for example, the refrigerant amount of the refrigerant circuit 10 may be determined using information on the length from the liquid-side shutoff valve 24 to the branch point X via the liquid-side main pipe 51 of the liquid-side connection pipe 5, the number of branch pipes (in the case of the refrigerant circuit configuration in FIG. 1, the two pipes of the first indoor liquid-side branch pipe 52*a* and the second indoor liquid-side branch pipe 52*b*), the lengths of the plurality of branch pipes (in the case of the refrigerant circuit configuration in FIG. 1, the length of the first indoor liquid-side branch pipe 52*a* and the length of the second indoor liquid-side branch pipe 52*b*), and the horsepower of the refrigeration apparatus 1. In this case, the refrigerant amount of the refrigerant to be charged to the refrigerant circuit 10 can be determined such that the refrigerant amount per unit length of the liquid-side main pipe 51 of the liquid-side connection pipe 5 increases as the length from the liquid-side shutoff valve 24 to the branch point X via the liquid-side main pipe 51 of the liquid-side connection pipe 5 is larger, such that the refrigerant amount increases as the number of the branch pipes is larger, such that the refrigerant amount increases as the length of each branch pipe is larger, and such that the refrigerant amount increases as the horsepower of the refrigeration apparatus 1 is larger. The refrigerant amount corresponding to the number of the branch pipes and the refrigerant amount corresponding to the length of each branch pipe may have a previously determined correspondence such that the refrigerant amount increases as the number of the branch pipes is larger and such that the refrigerant amount increases as the length of each branch pipe is larger, and the refrigerant amount corresponding to the number of the branch pipes and the length of each branch pipe may be determined using the correspondence. For example, in the case of the refrigerant circuit configuration in FIG. 1, the refrigerant amount for the liquid-side main pipe 51 of the liquid-side connection pipe 5 may be determined in accordance with the horsepower of the outdoor unit 2, the refrigerant amount for the first indoor liquid-side branch pipe 52*a* of the liquid-side connection pipe 5 may be determined in accordance with the horsepower of the first indoor unit 4*a*, the refrigerant amount for the second indoor liquid-side branch pipe 52*b* of the liquid-side connection pipe 5 may be determined in accordance with the horsepower of the second indoor unit 4*b*, and the refrigerant amount of the refrigerant circuit 10 may be determined by summing the determined refrigerant amounts. In this case, for example, for a refrigerant circuit having repeatedly branched portions, such as a case where an indoor liquid-side branch pipe is further branched and a plurality of indoor units are connected to a single indoor liquid-side branch pipe or a case where a pipe branched from an indoor liquid-side branch pipe is further branched, the refrigerant amount for each branched pipe may be determined in accordance with the horsepower of an indoor unit (if a plurality of indoor units are connected, the sum total of their horsepowers) that is connected to the distal end side (the side far from the liquid-side main pipe 51) with respect to the position of the branched pipe.

Alternatively, the refrigerant amount may be determined in accordance with the pipe diameter (inside diameter) of the liquid-side connection pipe 5 that is determined to be larger as the horsepower of the refrigeration apparatus 1 is larger, instead of determining the refrigerant amount in accordance with the horsepower of the refrigeration apparatus 1. More specifically, the pipe diameter of the liquid-side main pipe 51 of the liquid-side connection pipe 5 may be determined in accordance with the horsepower of the outdoor unit 2, the pipe diameter of the first indoor liquid-side branch pipe 52*a* of the liquid-side connection pipe 5 may be determined in accordance with the horsepower of the first indoor unit 4*a*, the pipe diameter of the second indoor liquid-side branch pipe 52*b* of the liquid-side connection pipe 5 may be determined in accordance with the horsepower of the second indoor unit 4*b*, and the refrigerant amount of the refrigerant circuit 10 may be determined in accordance with the capacity that is obtained by the product of the determined pipe diameter and the pipe length of each pipe (the total sum of the capacities of the pipes, each capacity grasped by the product of the pipe diameter and pipe length of each pipe).

Still alternatively, for the refrigeration apparatus 1 including the plurality of indoor units 4*a* and 4*b*, the refrigerant amount of the refrigerant circuit 10 may be determined using information on a length from an end portion of the liquid-side connection pipe 5 on the outdoor unit 2 side (the liquid-side shutoff valve 24) to an indoor unit located at the farthest position in a refrigeration path (a length of the longest portion) and the horsepower of the refrigeration apparatus 1. In this case, the refrigerant amount of the refrigerant to be charged to the refrigerant circuit 10 may be determined such that the refrigerant amount per unit length of the longest portion of the liquid-side connection pipe 5 increases as the length of the longest portion of the liquid-side connection pipe 5 is larger, and such that the refrigerant amount increases as the horsepower of the refrigeration apparatus 1 is larger.

For the refrigerant amount per unit length of the liquid-side connection pipe 5 determined in accordance with the length and so forth of the liquid-side connection pipe 5 by any of the above-described methods, the refrigerant amount per unit length may be written in, for example, an installation manual, in correspondence with the length of the liquid-side connection pipe 5. In this case, a refrigerant amount per unit length may be written for each length or each predetermined length range of the liquid-side connection pipe 5 in the form of a table such that the refrigerant amount per unit length of the liquid-side connection pipe 5 increases stepwise as the length of the liquid-side connection pipe 5 (for example, the length of the liquid-side main pipe 51 of the liquid-side connection pipe 5, or the length of the longest portion that is the length from the end portion of the liquid-side connection pipe 5 on the outdoor unit 2 side to the indoor unit located at the farthest position in the refrigerant path) is larger.

Alternatively, the refrigerant amount per unit length for each length or each predetermined length range of the liquid-side connection pipe 5 may be written further for each horsepower of the refrigeration apparatus 1 in the form of a table.

(4) Feature of Refrigerant-Amount Determining Method

In the refrigerant circuit 10 of the refrigeration apparatus 1 that uses the refrigerant-amount determining method according to this embodiment, the refrigerant condensed by the outdoor heat exchanger 22 is decompressed by the outdoor expansion valve 28, and the refrigerant with a decreased density is fed to the liquid-side connection pipe 5. Thus, the refrigerant amount of the refrigerant to be charged to the refrigerant circuit 10 can be decreased. Especially when the refrigerant is decompressed by the outdoor expansion valve 28 such that the refrigerant flowing through at least a portion on the downstream side of the liquid-side connection pipe 5 is in the gas-liquid two-phase state, the refrigerant amount of the refrigerant to be charged to the refrigerant circuit 10 can be sufficiently decreased as compared with a case where operation is performed such that the liquid-side connection pipe 5 is entirely filled with the liquid refrigerant.

In a refrigerant circuit of a refrigeration apparatus of related art, operation is performed such that a liquid-side connection pipe is filled with a liquid refrigerant. Hence, a charging refrigerant amount is determined using a refrigerant amount that is obtained by multiplying the length of the liquid-side connection pipe to be constructed on the site by a predetermined refrigerant amount per unit length.

In contrast, in the refrigerant circuit 10 of the refrigeration apparatus 1 that uses the refrigerant-amount determining method according to this embodiment, to decrease the refrigerant charging amount, the gas-liquid two-phase refrigerant transport control is performed in which the refrigerant to be fed to the liquid-side connection pipe 5 is decompressed by the outdoor expansion valve 28, and operation is performed such that the refrigerant in the gas-liquid two-phase state flows in at least a portion of the liquid-side connection pipe 5 located upstream of a downstream end portion thereof.

Thus, to execute the appropriate refrigeration cycle in which the target low pressure can be attained while the gas-liquid two-phase refrigerant transport control is performed, a portion where the refrigerant in the liquid state, not the refrigerant in the gas-liquid two-phase state, flows has to be increased because the pressure loss occurring in the refrigerant during transportation increases as the length of the liquid-side connection pipe 5 to be constructed on the site is larger (see the Mollier diagram in FIG. 4 in the case where the liquid-side connection pipe 5 is long as compared with the Mollier diagram in FIG. 3 in the case where the liquid-side connection pipe 5 is short). Due to this, even when the refrigerant amount of the refrigerant to be sealed in the refrigerant circuit 10 is to be decreased, there is a limit to execution of the appropriate refrigeration cycle in which the target low pressure can be attained while the gas-liquid two-phase refrigerant transport control is performed. The region in which the refrigerant in the gas-liquid two-phase state can flow has to be limited. Therefore, it is not possible to simply determine the refrigerant amount such that the refrigerant amount per unit length of the liquid-side connection pipe is constant like the related-art case where the liquid-side connection pipe is entirely filled with the liquid refrigerant (it is not possible to use the related-art simple refrigerant-amount determining method of grasping the refrigerant amount of the refrigerant to be sealed by multiplying the length of the liquid-side connection pipe by a uniform refrigerant amount per unit length regardless of the length of the liquid-side connection pipe).

In contrast, with the refrigerant-amount determining method according to this embodiment, the refrigerant amount in the refrigerant circuit 10, in which the gas-liquid two-phase refrigerant transport control is performed, is determined such that the refrigerant amount per unit length of the liquid-side connection pipe 5 increases as the length of the liquid-side connection pipe 5 is larger. In the refrigeration apparatus 1 that executes the appropriate refrigeration cycle in which the target low pressure can be attained while the gas-liquid two-phase refrigerant transport control is performed, even when the length of the liquid-side connection pipe 5 is large and the pressure loss occurring in the refrigerant during transportation increases, the appropriate refrigeration cycle can be performed in the refrigerant circuit 10.

In addition, with the refrigerant-amount determining method according to this embodiment, the refrigerant amount of the refrigerant circuit 10 is determined using the number and lengths of the indoor liquid-side branch pipes 52*a* and 52*b* and the horsepower of the refrigeration apparatus 1, in addition to the length of the liquid-side main pipe 51 of the liquid-side connection pipe 5. Thus, the refrigerant amount that allows the appropriate refrigeration cycle to be further reliably executed in the refrigerant circuit 10 in which the gas-liquid two-phase transport control is performed can be grasped.

By previously determining a corresponding refrigerant amount per unit length for each length or each predetermined length range of the liquid-side connection pipe 5 such that the refrigerant amount per unit length of the liquid-side connection pipe 5 increases stepwise as the length of the liquid-side connection pipe 5 is larger, the refrigerant amount on the construction site can be easily grasped. When the refrigerant amount is previously determined stepwise for each length or each predetermined length range of the liquid-side connection pipe 5 in this way, the number of combinations of the length and the refrigerant amount per unit length can be a limited number, and hence the arithmetic processing load for the previous determination can be small.

Furthermore, when the corresponding refrigerant amount per unit length for each length or each predetermined length range of the liquid-side connection pipe 5 determined such that the refrigerant amount per unit length of the liquid-side connection pipe 5 increases stepwise as the length of the liquid-side connection pipe 5 is larger is previously obtained further for each horsepower of the refrigeration apparatus 1 in the form of a table the refrigerant amount for each horsepower of the refrigeration apparatus 1 corresponding to the length of the liquid-side connection pipe 5 can be easily grasped.

(5) Refrigerant-Amount Determining Device

A refrigerant-amount determining device 100 according to another embodiment of the present invention is described below with reference to the drawings.

The refrigerant-amount determining device 100 is to cause the refrigerant-amount determining method according to the above-described embodiment to be executed using a computer and to automatically grasp the refrigerant amount. The refrigerant-amount determining device 100 is used for the refrigeration apparatus 1 described in the section of the refrigerant-amount determining method. More specifically, the refrigerant-amount determining device 100 is used for the refrigeration apparatus 1 including the refrigerant circuit 10 in which the above-described gas-liquid two-phase refrigerant transport control is performed.

(5-1) Basic Configuration of Refrigerant-Amount Determining Device

Figure 5:
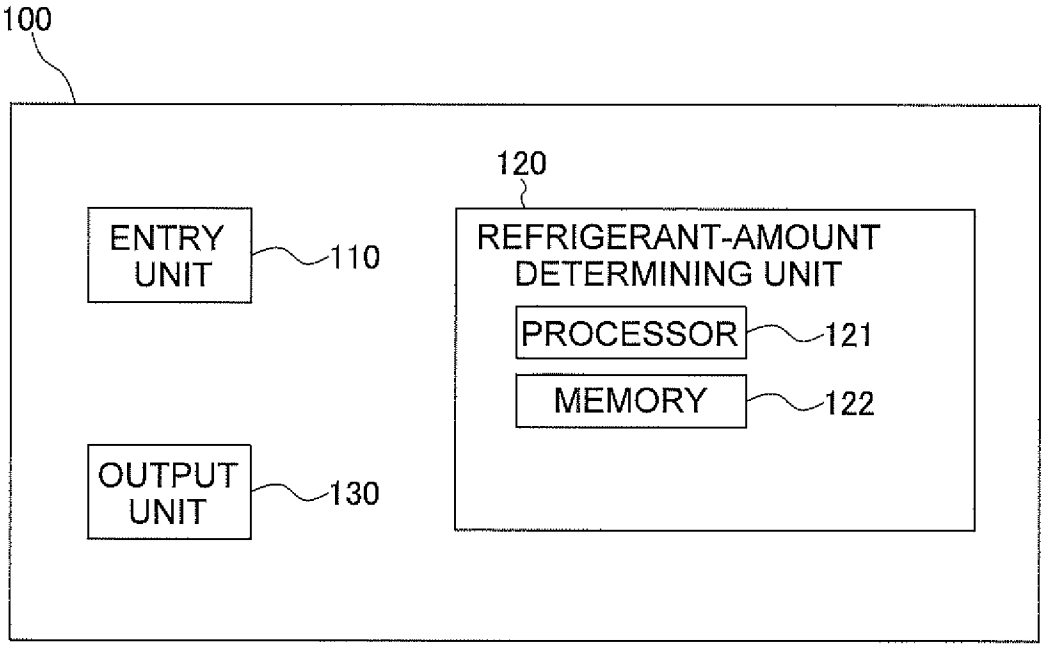
FIG. 5 is a block configuration diagram of a refrigerant-amount determining device.

As illustrated in a block configuration diagram of FIG. 5, the refrigerant-amount determining device 100 includes an entry unit 110, a refrigerant-amount determining unit 120, and an output unit 130.

The entry unit 110 receives information on the length of the liquid-side main pipe 51 of the liquid-side connection pipe 5 in the refrigeration apparatus 1 to be constructed on the site, the number of indoor units (the number of branch pipes), the length of each of the indoor liquid-side branch pipes 52*a* and 52*b* extending from the branch point X that is an end portion of the liquid-side main pipe 51 of the liquid-side connection pipe 5, and the horsepower of the refrigeration apparatus 1. In this case, the horsepower of the refrigeration apparatus 1 is not limited. For example, the horsepower of the outdoor unit 2 included in the refrigeration apparatus 1 may be used; in a case where the refrigeration apparatus 1 includes one indoor unit 4, the horsepower of the indoor unit 4 may be used; or in a case where the refrigeration apparatus 1 includes a plurality of indoor units 4 (the first indoor unit 4*a* and the second indoor unit 4*b*), the sum total of the respective horsepowers of the indoor units 4 may be used. In this embodiment, the entry unit 110 receives an input from a user using a screen of a touch panel or the like (described later).

The refrigerant-amount determining unit 120 determines the refrigerant amount of the refrigerant to be charged to the refrigerant circuit 10 on the basis of the various information received by the entry unit 110. The refrigerant-amount determining unit 120 includes a processor 121 including a CPU or the like that performs various information processing, and a memory 122 including at least one of a ROM and a RAM.

The processor 121 of the refrigerant-amount determining unit 120 performs determining processing for the refrigerant amount in a manner similar to the contents described in the section of the refrigerant-amount determining method. For example, the processor 121 may determine the refrigerant amount of the refrigerant circuit 10 on the basis of the information received through the entry unit 110 such that the refrigerant amount per unit length of the liquid-side main pipe 51 of the liquid-side connection pipe 5 increases as the length of the liquid-side main pipe 51 of the liquid-side connection pipe 5 is larger, such that the refrigerant amount increases as the number of indoor units (the number of branch pipes) is larger, such that the refrigerant amount increases as the length of each branch pipe is larger, and such that the refrigerant amount increases as the horsepower of the refrigeration apparatus 1 is larger. Moreover, for example, the processor 121 may determine the refrigerant amount of the refrigerant circuit 10 on the basis of the information received through the entry unit 110 such that the refrigerant amount per unit length of the longest portion of the liquid-side connection pipe 5 increases as the length of the longest portion of the liquid-side connection pipe 5 is larger, and such that the refrigerant amount increases as the horsepower of the refrigeration apparatus 1 is larger.

The output unit 130 outputs and displays the refrigerant amount determined by the refrigerant-amount determining unit 120. More specifically, the output unit 130 outputs and displays the value of the refrigerant amount on a screen of a touch panel or the like.

(5-2) Input Entry Processing of Various Information

The memory 122 of the refrigerant-amount determining device 100 stores, as screen display data for outputting and displaying by the output unit 130, entry screen display data for an entry by the entry unit 110, in addition to output screen display data for displaying the refrigerant amount determined by the refrigerant-amount determining unit 120.

Figure 6:
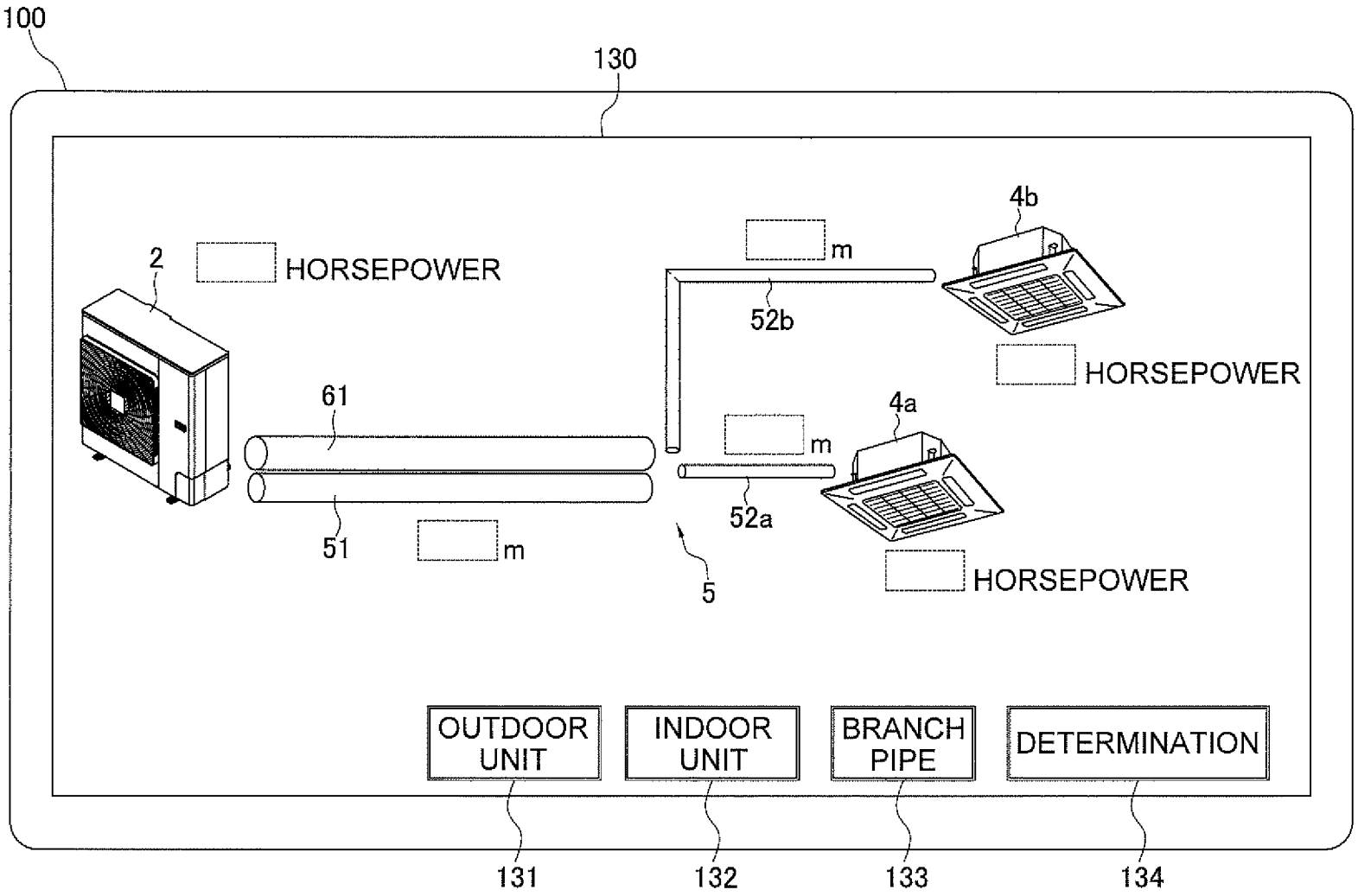
FIG. 6 illustrates an example of an entry screen display by the refrigerant-amount determining device.

As illustrated in FIG. 6, the entry screen display output and displayed by the output unit 130 is configured to receive an entry for data, such as the length of each pipe and the horsepower in a state in which image data imitating the outdoor unit 2, the indoor units 4*a* and 5*a*, the liquid-side main pipe 51 of the liquid-side connection pipe 5, the gas-side main pipe 61 of the gas-side connection pipe 6, and the branch pipes 52*a* and 52*b* are displayed (while the member numbers of the indoor unit and the liquid-side connection pipe are not displayed on the entry screen display, the member numbers are displayed in FIG. 6 for easier understanding).

More specifically, as illustrated in a lower right section of FIG. 6, on the entry screen display that is displayed by the output unit 130 on the basis of the entry screen display data stored in the memory 122, an outdoor unit button 131, an indoor unit button 132, a branch pipe button 133, and a determination button 134 are displayed. In this state, when the user presses the outdoor unit button 131, the indoor unit button 132, or the branch pipe button 133, an image icon corresponding to the pressed button is displayed on the screen. More specifically, for example, when the indoor unit button 132 is pressed two times, two image icons of indoor units are displayed, and when the branch pipe button 133 is pressed two times, two image icons of branch pipes are displayed. Each image icon data is previously stored in the memory 122. The user can create an image that matches with the refrigerant circuit configuration of the refrigeration apparatus 1 to be constructed, on the entry screen display, for example, by moving each image icon displayed on the screen as described above.

When the image of the refrigerant circuit configuration of the refrigeration apparatus 1 to be constructed is completed and the user presses the determination button 134, as illustrated in FIG. 6, the output unit 130 displays an input field for the length of each pipe and an input field for the horsepower of the refrigeration apparatus 1 (for example, an input field for the horsepower of the outdoor unit 2 and an input field for the horsepower of each indoor unit 4).

In this state, when the user inputs a specific value in each input field and presses the determination button 134 again, the entry processing for the information on the length of the liquid-side main pipe 51 of the liquid-side connection pipe 5, the number of indoor units (the number of branch pipes), the length of each branch pipe, and the horsepower by the entry unit 110 is ended.

With the refrigerant-amount determining device 100, the length of each pipe and so forth can be input while the specific image of the refrigerant circuit configuration is visually checked, and hence an error in the correspondence between each pipe and the length thereof can be easily checked.

(5-3) Refrigerant-Amount Determining Processing by Refrigerant-Amount Determining Unit With the refrigerant-amount determining device 100 that has received the various information by the entry unit 110 as described above, the refrigerant-amount determining unit 120 performs refrigerant-amount determining processing on the basis of the received information.

In this case, the memory 122 of the refrigerant-amount determining unit 120 previously stores, for each pipe diameter (inside diameter) corresponding to the horsepower of the refrigeration apparatus 1, information on a correspondence of the refrigerant amount per unit length corresponding to the length of the pipe such that the refrigerant amount per unit length increases as the length of the liquid-side connection pipe 5 (for example, the length of the liquid-side main pipe 51 of the liquid-side connection pipe 5, or the length of the longest portion that is the length from the end portion of the liquid-side connection pipe 5 on the outdoor unit 2 side to the farthest indoor unit in the refrigerant path) is larger. Alternatively, the memory 122 may previously store information on a correspondence of the refrigerant amount per unit length for each predetermined length range of the liquid-side connection pipe 5 such that the refrigerant amount per unit length of the liquid-side connection pipe 5 increases stepwise as the length of the liquid-side connection pipe 5 is larger. Further, the memory 122 may previously store information on a correspondence of the corresponding refrigerant amount per unit length for each predetermined length range of the liquid-side connection pipe 5 and further for each horsepower of the refrigeration apparatus 1.

The processor 121 specifies the refrigerant amount per unit length corresponding to the received horsepower and the received length of the liquid-side connection pipe 5 from the information on the correspondence stored in the memory 122, multiplies the received length of the liquid-side connection pipe 5 by the specified refrigerant amount per unit length, and may grasp the refrigerant amount corresponding to the liquid-side connection pipe 5 having the received length.

The memory 122 of the refrigerant-amount determining unit 120 may previously store information on a correspondence of the refrigerant amount corresponding to the number of indoor units (the number of branch pipes) of the refrigeration apparatus 1 and the lengths of the branch pipes that connect the liquid-side connection pipe 5 to the indoor units 4*a* and 4*b* (the length of the first indoor liquid-side branch pipe 52*a* and the length of the second indoor liquid-side branch pipe 52*b*), and the processor 121 of the refrigerant-amount determining unit 120 may reference the information on the correspondence, and may grasp the refrigerant amount corresponding to the number of the indoor units (the number of the branch pipes) and the lengths of the branch pipes received by the entry unit 110.

In this way, the processor 121 of the refrigerant-amount determining unit 120 determines the refrigerant amount or the like that is obtained by summing the refrigerant amount corresponding to the liquid-side connection pipe 5 and the refrigerant amount corresponding to the number of the indoor units and the length of each branch pipe, as the refrigerant amount of the refrigerant circuit 10. Then, as described above, the output unit 130 outputs and displays the refrigerant amount determined by the refrigerant-amount determining unit 120 on the display screen using the output screen display data.

With the refrigerant-amount determining device 100, an advantageous effect similar to that of the refrigerant-amount determining method according to the above-described embodiment can be obtained and in addition the user can input each data while visually checking the refrigerant circuit configuration of the refrigeration apparatus 1.

(6) Modifications

The above-described embodiment can be appropriately modified as described in the following modifications. It is to be noted that each modification may be applied in combination with another modification unless otherwise the modifications conflict with each other.

(6-1) Modification A

In the above-described embodiment, the example has been described in which the length from the liquid-side shutoff valve 24 to the branch point X is used as the length of the liquid-side main pipe 51 of the liquid-side connection pipe 5.

In contrast, a length from the outdoor expansion valve 28 to the branch point X may be used as the length of the liquid-side main pipe 51 of the liquid-side connection pipe 5.

(6-2) Modification B

For the above-described refrigerant-amount determining method, the example has been described in which the refrigerant amount per unit length corresponding to the length of the liquid-side connection pipe 5 is previously determined for each pipe diameter (inside diameter) corresponding to the horsepower of the refrigeration apparatus 1, and the refrigerant amount corresponding to the length of the liquid-side connection pipe 5 is determined by multiplying the length of the liquid-side connection pipe 5 by the corresponding refrigerant amount per unit length.

In contrast, a specific refrigerant amount corresponding to the length of the liquid-side connection pipe 5 may be determined for each pipe diameter (inside diameter) corresponding to the horsepower of the refrigeration apparatus 1 (a refrigerant amount corresponding to the length of the liquid-side connection pipe 5, the refrigerant amount which satisfies the relationship that the refrigerant amount per unit length is larger as the length of the liquid-side connection pipe 5 is larger), and the refrigerant amount corresponding to the length of the liquid-side connection pipe 5 may be determined on the basis of the predetermined relationship.

This point is similarly applied to the refrigerant-amount determining device. The memory 122 may previously store a specific refrigerant amount corresponding to the length of the liquid-side connection pipe 5 for each pipe diameter (inside diameter) corresponding to the horsepower of the refrigeration apparatus 1 (a refrigerant amount corresponding to the length of the liquid-side connection pipe 5, the refrigerant amount which satisfies the relationship that the refrigerant amount per unit length is larger as the length of the liquid-side connection pipe 5 is larger). In this case, the processor 121 specifies the refrigerant amount corresponding to the input horsepower and the length of the liquid-side connection pipe 5, and grasps the specified refrigerant amount as the refrigerant amount corresponding to the liquid-side connection pipe 5 having the received length.

Regarding the relationship between the previously determined length of the liquid-side connection pipe 5 and its specific refrigerant amount, a corresponding specific refrigerant amount may be written in, for example, an installation manual in correspondence with the length of the liquid-side connection pipe 5.

(6-3) Modification C

In the above-described embodiment, the example has been described in which the corresponding refrigerant amount per unit length for each length and so forth of the liquid-side connection pipe 5 and for each horsepower of the refrigeration apparatus 1 is written in a table, and the refrigerant amount is grasped by multiplying the length etc. of the liquid-side connection pipe 5 to be constructed by the refrigerant amount per unit length grasped from the table.

In contrast, the way of obtaining the refrigerant amount such that the refrigerant amount per unit length increases as the length etc. of the liquid-side connection pipe 5 is larger is not limited to the example.

For example, a correspondence table, in which a corresponding predetermined refrigerant charging rate (% of the refrigerant amount of the refrigerant to be charged when the refrigerant amount of the refrigerant charged to the liquid-side main pipe 51 of the liquid-side connection pipe 5 in the state in which the liquid-side main pipe 51 of the liquid-side connection pipe 5 is filled with the liquid refrigerant is 100%) for each predetermined length range of the liquid-side main pipe 51 of the liquid-side connection pipe 5 to be constructed is indicated for each horsepower of the refrigeration apparatus 1, may be prepared, and the predetermined refrigerant charging rate may be specified in accordance with the horsepower of the refrigeration apparatus 1 to be constructed, and the length of the liquid-side main pipe 51 of the liquid-side connection pipe 5 to be constructed. Then, the appropriate refrigerant amount corresponding to the liquid-side main pipe 51 of the liquid-side connection pipe 5 to be constructed may be grasped by multiplying the refrigerant amount of the refrigerant charged to the liquid-side main pipe 51 of the liquid-side connection pipe 5 in the state in which the liquid-side main pipe 51 of the liquid-side connection pipe 5 is filled with the liquid refrigerant by the charging rate specified as described above. The correspondence table is determined such that the refrigerant amount per unit length of the liquid-side main pipe 51 of the liquid-side connection pipe 5 increases as the length of the liquid-side main pipe 51 of the liquid-side connection pipe 5 is larger and as the horsepower of the refrigeration apparatus 1 is larger.

Alternatively, the correspondence table may indicate a predetermined refrigerant charging rate corresponding to each horsepower of the refrigeration apparatus 1, for each predetermined length range (the length of the longest portion) from the end portion of the liquid-side connection pipe 5 on the outdoor unit 2 side to the indoor unit located at the farthest position in the refrigerant path included in the refrigeration apparatus 1 to be constructed, instead of the predetermined refrigerant charging rate corresponding to each horsepower of the refrigeration apparatus 1, for each predetermined length range of the liquid-side main pipe 51 of the liquid-side connection pipe 5 of the refrigeration apparatus 1 to be constructed. Then, the appropriate refrigerant amount corresponding to the length of the longest portion of the liquid-side connection pipe 5 of the refrigeration apparatus 1 to be constructed may be grasped by multiplying the refrigerant amount of the refrigerant charged to the portion in the state in which the liquid-side connection pipe 5 is entirely filled with the liquid refrigerant by the charging rate specified as described above.

If the longest portion of the liquid-side main pipe 51 of the liquid-side connection pipe 5 is not constructed on a made-to-order basis, but is constructed by selecting the longest portion from plural types of predetermined lengths, a predetermined refrigerant charging rate corresponding to each horsepower of the refrigeration apparatus 1 may be indicated for each of these lengths.

By preparing the correspondence table as described above, the appropriate refrigerant amount corresponding to the horsepower of the refrigeration apparatus 1 and the length and so forth of the liquid-side connection pipe 5 can be easily grasped.

(6-4) Modification D

Alternatively, another way of obtaining the refrigerant amount such that the refrigerant amount per unit length increases as the length and so forth of the liquid-side connection pipe 5 is larger may be as follows.

For example, a correspondence table, in which a corresponding predetermined refrigerant reducing rate (% of the refrigerant amount of the refrigerant to be reduced when the refrigerant amount of the refrigerant charged to the liquid-side main pipe 51 of the liquid-side connection pipe 5 in the state in which the liquid-side main pipe 51 of the liquid-side connection pipe 5 is filled with the liquid refrigerant is 100%) for each predetermined length range of the liquid-side main pipe 51 of the liquid-side connection pipe 5 to be constructed is indicated further for each horsepower of the refrigeration apparatus 1, is prepared. Then, based on the correspondence table, the predetermined refrigerant reducing rate is specified in accordance with the horsepower of the refrigeration apparatus 1 to be constructed and the length of the liquid-side main pipe 51 of the liquid-side connection pipe 5 to be constructed, and the appropriate refrigerant amount corresponding to the liquid-side main pipe 51 of the liquid-side connection pipe 5 to be constructed can be grasped by multiplying the refrigerant amount of the refrigerant charged to the liquid-side main pipe 51 of the liquid-side connection pipe 5 in the state in which the liquid-side main pipe 51 of the liquid-side connection pipe 5 is filled with the liquid refrigerant by (1−the specified predetermined refrigerant reducing rate). The correspondence table is determined, similarly to the above description, such that the refrigerant amount per unit length of the liquid-side main pipe 51 of the liquid-side connection pipe 5 increases as the length of the liquid-side main pipe 51 of the liquid-side connection pipe 5 is larger and as the horsepower of the refrigeration apparatus 1 is larger.

Alternatively, the correspondence table may indicate a predetermined refrigerant reducing rate corresponding to each horsepower of the refrigeration apparatus 1, for each predetermined length range (the length of the longest portion) from the end portion of the liquid-side connection pipe 5 on the outdoor unit 2 side to the indoor unit located at the farthest position in the refrigerant path included in the refrigeration apparatus 1 to be constructed, instead of the predetermined refrigerant reducing rate corresponding to each horsepower of the refrigeration apparatus 1, for each predetermined length range of the liquid-side main pipe 51 of the liquid-side connection pipe 5 of the refrigeration apparatus 1 to be constructed. Then, the appropriate refrigerant amount corresponding to the length of the longest portion of the liquid-side connection pipe 5 of the refrigeration apparatus 1 to be constructed may be grasped by multiplying the refrigerant amount of the refrigerant charged to the portion in the state in which the liquid-side connection pipe 5 is entirely filled with the liquid refrigerant by the reducing rate specified as described above.

If the longest portion of the liquid-side main pipe 51 of the liquid-side connection pipe 5 is not constructed on a made-to-order basis, but is constructed by selecting the longest portion from plural types of predetermined lengths, the predetermined refrigerant reducing rate corresponding to each horsepower of the refrigeration apparatus 1 may be indicated for each of these lengths.

FIG. 7 shows a table indicating a predetermined refrigerant reducing rate corresponding to each horsepower of the refrigeration apparatus 1 for each length of the longest portion of the liquid-side connection pipe 5 included in the refrigeration apparatus 1 to be constructed. In the correspondence table of FIG. 7, predetermined ranges are written for the length of the longest portion of the liquid-side connection pipe 5, and predetermined ranges are written for the sum total of the horsepowers of the indoor units 4 connected to the outdoor unit 2 of the refrigeration apparatus 1.

By preparing the correspondence table as described above, the appropriate refrigerant amount corresponding to the horsepower of the refrigeration apparatus 1 and the length and so forth of the liquid-side connection pipe 5 can be easily grasped.

(6-5) Modification E

Alternatively, another way of obtaining the refrigerant amount such that the refrigerant amount per unit length increases as the length and so forth of the liquid-side connection pipe 5 is larger may be as follows.

For example, when the refrigeration apparatus 1 is configured by connecting a single indoor unit 4 to a single outdoor unit 2 via the liquid-side connection pipe 5, each refrigerant density per predetermined unit length from an end portion of the liquid-side connection pipe 5 on the indoor unit 4 side may be previously determined such that the refrigerant in a gas-liquid two-phase state with the lowest density exists in the end portion of the liquid-side connection pipe 5 on the indoor unit 4 side and the density gradually increases toward an end portion of the liquid-side connection pipe 5 on the outdoor unit 2 side (in some cases, such that a liquid refrigerant exists from an intermediate position instead of the refrigerant in the gas-liquid two-phase state).

Then, the refrigerant amount of each portion may be grasped for each predetermined unit length from the end portion of the liquid-side connection pipe 5 on the indoor unit 4 side by multiplying a capacity (a capacity obtained by multiplying a pipe diameter (inside diameter of the liquid-side connection pipe 5 by a predetermined unit length) by a corresponding refrigerant density, and an appropriate refrigerant amount for the liquid-side connection pipe 5 may be grasped by summing refrigerant amounts grasped for the predetermined unit lengths (by integrating the refrigerant amounts). Even in this case, the refrigerant amount is determined such that the refrigerant amount per unit length of the liquid-side connection pipe 5 increases as the length of the liquid-side connection pipe 5 is larger.

Moreover, for example, when the refrigeration apparatus 1 is configured such that the plurality of indoor units 4*a* and 4*b* are connected to the single outdoor unit 2 via the liquid-side main pipe 51 and the indoor liquid-side branch pipes 52*a* and 52*b* of the liquid-side connection pipe 5, each refrigerant density per predetermined unit length from an end portion of the indoor liquid-side branch pipe 52*a* on the indoor unit 4*a* side may be previously determined such that the refrigerant in a gas-liquid two-layer state with the lowest density exists in the end portion of the indoor liquid-side branch pipe 52*a* on the indoor unit 4*a* side connected to the indoor unit 4*a* located at the farthest position from an end portion of the liquid-side connection pipe 5 on the outdoor unit 2 side in the refrigerant path and the density gradually increases toward the end portion of the liquid-side connection pipe 5 on the outdoor unit 2 side (in some cases, such that the liquid refrigerant exists from an intermediate position instead of the refrigerant in the gas-liquid two-layer state). Then, for the indoor liquid-side branch pipe 52*b* connected to the other indoor unit 4*b*, the refrigerant density per unit length can be determined to be lower toward the indoor unit 4*b* with reference to the refrigerant density previously determined for an end portion of the indoor liquid-side branch pipe 52*b* on the side opposite to the indoor unit 4*b* side. As described above, the appropriate refrigerant amount may be grasped by integration similarly to the above except that the refrigerant density per predetermined unit length is determined for each of the liquid-side main pipe 51 and the indoor liquid-side branch pipes 52*a* and 52*b* of the liquid-side connection pipe 5 and each refrigerant density is multiplied by the pipe diameter of corresponding one of the liquid-side main pipe 51 and the indoor liquid-side branch pipes 52*a* and 52*b* of the liquid-side connection pipe 5.

INDUSTRIAL APPLICABILITY

The present invention can be used as a refrigerant-amount determining method and a refrigerant-amount determining device.

REFERENCE SIGNS LIST

1 refrigeration apparatus
5 liquid-side connection pipe
6 gas-side connection pipe
7 control unit
10 refrigerant circuit
21 compressor
22 outdoor heat exchanger
23 outdoor liquid-refrigerant pipe
24 liquid-side shutoff valve
25 gas-side shutoff valve
26 outdoor fan
27 four-way switching valve
28 outdoor expansion valve
29 accumulator
30 controller
31 outdoor control portion
32 suction pressure sensor
33 discharge pressure sensor
34 suction temperature sensor
35 discharge temperature sensor
36 outdoor heat-exchange liquid-side temperature sensor
37 liquid-pipe temperature sensor
38 outside air temperature sensor
41*a* first indoor heat exchanger
41*b* second indoor heat exchanger
42*a* first indoor fan
42*b* second indoor fan
44*a* first indoor expansion valve
44*b* second indoor expansion valve
45*a* first indoor refrigerant temperature sensor
45*b* second indoor refrigerant temperature sensor
46*a* first indoor control portion
46*b* second indoor control portion
51 liquid-side main pipe
52*a* first indoor liquid-side branch pipe (branch pipe)
52*b* second indoor liquid-side branch pipe (branch pipe)
61 gas-side main pipe
62*a* first indoor gas-side branch pipe
62*b* second indoor gas-side branch pipe
100 refrigerant-amount determining device
110 entry unit
120 refrigerant-amount determining unit
130 output unit
131 outdoor unit button
132 indoor unit button
133 branch pipe button
134 determination button

CITATION LIST

Patent Literature

PTL 1: Japanese Unexamined Patent Application Publication No. 8-200905

The invention claimed is:

1. A refrigerant-amount determining method for a refrigerant to be charged to a refrigeration apparatus including a refrigerant circuit in which a compressor, a condenser, a first expansion valve, an evaporator, a liquid-side connection pipe that feeds the refrigerant, which has passed through the condenser and then has been decompressed by the first expansion valve, to the evaporator, and a gas-side connection pipe that feeds the refrigerant, which has passed through the evaporator, to a suction side of the compressor, are connected to one another, the method comprising:

determining a refrigerant amount of the refrigerant to be charged to the refrigerant circuit as a function of a length of the liquid-side connection pipe, wherein a refrigerant amount per unit length of the liquid-side connection pipe increases as the length of the liquid-side connection pipe increases.

2. The refrigerant-amount determining method according to claim 1, wherein a correspondence in which a predetermined refrigerant reducing rate or a predetermined refrigerant charging rate corresponding to each predetermined length range or each predetermined length of the liquid-side connection pipe is indicated for each horsepower of the refrigeration apparatus is determined, and the refrigerant amount of the refrigerant to be charged to the refrigerant circuit is determined on the basis of the correspondence, the predetermined refrigerant reducing rate is a refrigerant reducing rate with reference to a refrigerant amount of a refrigerant charged to the liquid-side connection pipe in a case where the liquid-side connection pipe is filled with a liquid refrigerant, the predetermined refrigerant charging rate is a refrigerant charging rate with reference to the refrigerant amount of the refrigerant charged to the liquid-side connection pipe in the case where the liquid-side connection pipe is filled with the liquid refrigerant, and a refrigerant amount is obtained by performing a calculation according to a first equation of the refrigerant amount is equal to (the refrigerant amount in the case of the filling with the liquid refrigerant)×(1−the predetermined refrigerant reducing rate), or a refrigerant amount is obtained by performing another calculation according to a second equation of the refrigerant amount is equal to (the refrigerant amount in the case of the filling with the liquid refrigerant)×(the predetermined refrigerant charging rate), and a refrigerant amount per unit length of the obtained refrigerant amount is determined to increase as the length of the liquid-side connection pipe increases and the horsepower of the refrigeration apparatus increases.

3. The refrigerant-amount determining method according to claim 1, wherein the refrigeration apparatus includes a liquid-side shutoff valve and a plurality of the evaporators that are connected in parallel with each other, the liquid-side connection pipe includes a liquid-side main pipe that extends from the liquid-side shutoff valve to a branch point located at an intermediate position of the liquid-side connection pipe, and branch pipes that are branched at the branch point and respectively extend to the plurality of evaporators, and the refrigerant amount is determined using the specific value corresponding to a length from the first expansion valve or the liquid-side shutoff valve to the branch point via the liquid-side main pipe, the number of the branch pipes, and lengths of a plurality of the branch pipes.

4. The refrigerant-amount determining method according to claim 3, wherein the refrigerant amount is determined using a pipe diameter of the liquid-side connection pipe, the pipe diameter being determined in accordance with a horsepower of the refrigeration apparatus.

5. The refrigerant-amount determining method according to claim 3, wherein a correspondence in which a predetermined refrigerant reducing rate or a predetermined refrigerant charging rate corresponding to each predetermined length range or each predetermined length of the liquid-side connection pipe is indicated for each horsepower of the refrigeration apparatus is determined, and the refrigerant amount of the refrigerant to be charged to the refrigerant circuit is determined on the basis of the correspondence, the predetermined refrigerant reducing rate is a refrigerant reducing rate with reference to a refrigerant amount of a refrigerant charged to the liquid-side connection pipe in a case where the liquid-side connection pipe is filled with a liquid refrigerant, the predetermined refrigerant charging rate is a refrigerant charging rate with reference to the refrigerant amount of the refrigerant charged to the liquid-side connection pipe in the case where the liquid-side connection pipe is filled with the liquid refrigerant, and a refrigerant amount is obtained by performing a calculation according to a first equation of the refrigerant amount is equal to (the refrigerant amount in the case of the filling with the liquid refrigerant)×(1−the predetermined refrigerant reducing rate), or a refrigerant amount is obtained by performing another calculation according to a second equation of the refrigerant amount is equal to (the refrigerant amount in the case of the filling with the liquid refrigerant)×(the predetermined refrigerant charging rate), and a refrigerant amount per unit length of the obtained refrigerant amount is determined to increase as the length of the liquid-side connection pipe increases and the horsepower of the refrigeration apparatus increases.

6. The refrigerant-amount determining method according to claim 1, wherein the refrigerant amount is determined using a pipe diameter of the liquid-side connection pipe, the pipe diameter being determined in accordance with a horsepower of the refrigeration apparatus.

7. The refrigerant-amount determining method according to claim 6, wherein a correspondence in which a predetermined refrigerant reducing rate or a predetermined refrigerant charging rate corresponding to each predetermined length range or each predetermined length of the liquid-side connection pipe is indicated for each horsepower of the refrigeration apparatus is determined, and the refrigerant amount of the refrigerant to be charged to the refrigerant circuit is determined on the basis of the correspondence, the predetermined refrigerant reducing rate is a refrigerant reducing rate with reference to a refrigerant amount of a refrigerant charged to the liquid-side connection pipe in a case where the liquid-side connection pipe is filled with a liquid refrigerant, the predetermined refrigerant charging rate is a refrigerant charging rate with reference to the refrigerant amount of the refrigerant charged to the liquid-side connection pipe in the case where the liquid-side connection pipe is filled with the liquid refrigerant, and a refrigerant amount is obtained by performing a calculation according to a first equation of the refrigerant amount is equal to (the refrigerant amount in the case of the filling with the liquid refrigerant)×(1−the predetermined refrigerant reducing rate), or a refrigerant amount is obtained by performing another calculation according to a second equation of the refrigerant amount is equal to (the refrigerant amount in the case of the filling with the liquid refrigerant)×(the predetermined refrigerant charging rate), and a refrigerant amount per unit length of the obtained refrigerant amount is determined to increase as the length of the liquid-side connection pipe increases and the horsepower of the refrigeration apparatus increases.

8. A refrigerant-amount determining device for a refrigerant to be charged to a refrigeration apparatus including a refrigerant circuit in which a compressor, a condenser, a first expansion valve, an evaporator, a liquid-side connection pipe that feeds the refrigerant, which has passed through the condenser and then has been decompressed by the first expansion valve, to the evaporator, and a gas-side connection pipe that feeds the refrigerant, which has passed through the evaporator, to a suction side of the compressor, are connected to one another, the device comprising: an entry unit that receives information on at least a length of the liquid-side connection pipe; a refrigerant-amount determining unit that determines a refrigerant amount of the refrigerant to be charged to the refrigerant circuit as a function of a length of the liquid side-connection pipe, on the basis of the information on the length of the liquid-side connection pipe received by the entry unit, wherein a refrigerant amount per unit length of the liquid-side connection pipe increases as the length of the liquid-side connection pipe increases; and an output unit that outputs the refrigerant amount determined by the refrigerant-amount determining unit.

9. The refrigerant-amount determining device according to claim 8, wherein the entry unit further receives information on a horsepower of the refrigeration apparatus, and the refrigerant-amount determining unit obtains a pipe diameter of the liquid-side connection pipe, the pipe diameter being determined in accordance with the information on the horsepower received by the entry unit, on the basis of previously owned data, and determines the refrigerant amount using the pipe diameter of the liquid-side connection pipe.

10. The refrigerant-amount determining device according to claim 8, wherein the refrigeration apparatus includes a plurality of the evaporators that are connected in parallel with each other and a liquid-side shutoff valve that is provided between the plurality of evaporators and the first expansion valve, the liquid-side connection pipe includes a liquid-side main pipe that extends from the liquid-side shutoff valve to a branch point located at an intermediate position of the liquid-side connection pipe, and branch pipes that are branched at the branch point and respectively extend to the plurality of evaporators, the entry unit further receives information on a length from the first expansion valve or the liquid-side shutoff valve to the branch point via the liquid-side main pipe, the number of the branch pipes, and lengths of a plurality of the branch pipes, and the refrigerant-amount determining unit determines the refrigerant amount using the information on the length from the first expansion valve or the liquid-side shutoff valve to the branch point via the liquid-side main pipe, the number of the branch pipes, and the lengths of the plurality of branch pipes received by the entry unit.

11. The refrigerant-amount determining device according to claim 10, wherein the entry unit further receives information on a horsepower of the refrigeration apparatus, and the refrigerant-amount determining unit obtains a pipe diameter of the liquid-side connection pipe, the pipe diameter being determined in accordance with the information on the horsepower received by the entry unit, on the basis of previously owned data, and determines the refrigerant amount using the pipe diameter of the liquid-side connection pipe.

12. The refrigerant-amount determining device according to claim 10, further comprising:

an image display unit that displays the branch pipes and the evaporators by at least the number received by the entry unit, and the liquid-side main pipe using previously owned image data, and that displays input fields at positions corresponding to the plurality of branch pipes and the liquid-side main pipe, for receiving inputs of lengths of the plurality of branch pipes and the liquid-side main pipe, wherein the entry unit receives values input in the input fields displayed on the image display unit.

13. The refrigerant-amount determining device according to claim 12, wherein the entry unit further receives information on a horsepower of the refrigeration apparatus, and the refrigerant-amount determining unit obtains a pipe diameter of the liquid-side connection pipe, the pipe diameter being determined in accordance with the information on the horsepower received by the entry unit, on the basis of previously owned data, and determines the refrigerant amount using the pipe diameter of the liquid-side connection pipe.

* * * * *